US009089207B2

(12) United States Patent
Ruiter et al.

(10) Patent No.: US 9,089,207 B2
(45) Date of Patent: Jul. 28, 2015

(54) CONFERENCE TABLE WITH MOVABLE TABLE TOP AND GANGING CAPABILITY

(71) Applicant: Nucraft Furniture Company, Comstock Park, MI (US)

(72) Inventors: Joel T. Ruiter, Grand Rapids, MI (US); Robert J. Bockheim, Grand Rapids, MI (US)

(73) Assignee: NUCRAFT FURNITURE COMPANY, Comstock Park, MI (US)

( * ) Notice: Subject to any disclaimer, the term of this patent is extended or adjusted under 35 U.S.C. 154(b) by 0 days.

(21) Appl. No.: 14/015,448

(22) Filed: Aug. 30, 2013

(65) Prior Publication Data

US 2014/0060395 A1 Mar. 6, 2014

Related U.S. Application Data

(60) Provisional application No. 61/697,036, filed on Sep. 5, 2012.

(51) Int. Cl.

| | |
|---|---|
| ***A47B 91/00*** | (2006.01) |
| ***A47B 13/08*** | (2006.01) |
| ***A47B 96/04*** | (2006.01) |
| ***A47B 87/00*** | (2006.01) |
| ***A47B 97/00*** | (2006.01) |

(52) U.S. Cl.

CPC ..... *A47B 13/081* (2013.01); *A47B 87/002* (2013.01); *A47B 96/04* (2013.01); *A47B 97/00* (2013.01); *A47B 2200/0079* (2013.01); *Y10T 29/49826* (2015.01)

(58) Field of Classification Search

CPC ..... A47B 21/06; A47B 87/02; B23Q 1/621

USPC ..... 108/50.02, 64, 137, 143, 191

See application file for complete search history.

(56) References Cited

U.S. PATENT DOCUMENTS

| | | | | |
|---|---|---|---|---|
| 2,284,917 | A * | 6/1942 | Nelson | 108/143 |
| 4,130,070 | A * | 12/1978 | Herrin | 108/143 |
| D292,545 | S | 11/1987 | Peacock | |
| 5,549,055 | A | 8/1996 | Kusch | |
| 6,024,024 | A * | 2/2000 | Favaretto | 108/64 |
| 6,397,762 | B1 * | 6/2002 | Goldberg et al. | 108/50.02 |
| 6,955,464 | B1 * | 10/2005 | Tybinkowski et al. | 378/209 |
| D562,599 | S | 2/2008 | Everson et al. | |
| 7,367,273 | B2 * | 5/2008 | Shinoda | 108/143 |
| 7,438,098 | B2 * | 10/2008 | Liu et al. | 144/286.5 |
| 7,640,866 | B1 * | 1/2010 | Schermerhorn | 108/50.02 |
| D611,997 | S | 3/2010 | De Viveiros Ortiz | |

(Continued)

*Primary Examiner* — Hanh V Tran

(74) *Attorney, Agent, or Firm* — Gardner, Linn, Burkhart & Flory, LLP

(57) ABSTRACT

A table includes a base and a table top that is movably disposed at the base and is movable relative to the base between a generally centered position, where the table top is generally centered at the base, and an extended position, where the table top is extended from the base. A braking device may be operable to retain the table top relative to the base in selected positions between the generally centered position and the extended position and to allow for movement of the table top relative to the base between the generally centered position and the extended position. The braking device may include a braking element that engages a braking rail to limit movement of the table top relative to the base. The table tops of two separated tables may be selectively joined when extended towards one another and separated when centered.

21 Claims, 22 Drawing Sheets

(56) References Cited

U.S. PATENT DOCUMENTS

| | | | | |
|---|---|---|---|---|
| D664,792 | S | 8/2012 | Gustafson et al. | |
| D687,657 | S | 8/2013 | Ruiter et al. | |
| 2004/0060482 | A1* | 4/2004 | Torcheboeuf | 108/20 |
| 2005/0268823 | A1* | 12/2005 | Bakker et al. | 108/50.02 |
| 2006/0042520 | A1* | 3/2006 | Stevens et al. | 108/50.02 |
| 2009/0133609 | A1* | 5/2009 | Nethken et al. | 108/50.02 |
| 2009/0165680 | A1* | 7/2009 | Bakker et al. | 108/50.02 |
| 2009/0260547 | A1* | 10/2009 | Epstein et al. | 108/50.02 |
| 2010/0031856 | A1* | 2/2010 | Shoda et al. | 108/21 |
| 2010/0212554 | A1* | 8/2010 | Chou et al. | 108/143 |

* cited by examiner

CONFERENCE TABLE WITH MOVABLE TABLE TOP AND GANGING CAPABILITY

CROSS REFERENCE TO RELATED APPLICATION

The present application claims the filing benefits of U.S. provisional application Ser. No. 61/697,036, filed Sep. 5, 2012, which is hereby incorporated herein by reference in its entirety.

FIELD OF THE INVENTION

The present invention relates generally to office furniture and, more particularly, to conference tables for conference rooms.

BACKGROUND OF THE INVENTION

Conference rooms in office settings are often fixed at a desired location in a room. When it is desired to provide a larger table or working surface, a second conference table may be brought into the room and the two conference tables may be moved relative to one another to provide a dual table top arrangement in the conference room, if the conference room is large enough to accommodate two conference tables.

SUMMARY OF THE INVENTION

The present invention provides a conference room table with a table top that slides or moves relative to its base or pedestal, so that the table top may be moved from a centered location or arrangement to an extended or offset arrangement (in either or both directions relative to the base), while the base of the table remains fixedly disposed in the room. The table top thus may be adjusted to provide additional room or clearance at one end or to move the table top towards and into engagement with another similarly moved table top to join two separate conference tables into a single unit, without having to move the bases or pedestals of the conference tables.

According to an aspect of the present invention, a conference room table includes a base, a table top movably disposed at the base and movable relative to the base between a generally centered position, where the table top is generally centered at the base, and an extended position, where the table top is extended from the base, and a braking or locking or securing device that is operable to retain the table top relative to the base in any desired position between the generally centered position and the extended position and to allow for movement of the table top relative to the base between the generally centered position and the extended position. Optionally, the table top may support at least one electrical accessory, and wiring may extend from the base to the table top via a unidirectional flexing track that flexes in one direction and is substantially non-flexible in a direction transverse to the one direction.

According to another aspect of the present invention, a table system includes a first table comprising a first base and a first table top movably disposed at the first base, and a second table comprising a second base and a second table top movably disposed at the second base. The first and second tables are spaced apart from one another and, when the first table top is in the first generally centered position and the second table top is in the second generally centered position, opposing ends of the first and second table tops are spaced apart from one another, and wherein, when the first table top is in the first extended position and the second table top is in the second extended position, the opposing ends of the first and second table tops abut one another and cooperate to form a single table top.

Optionally, when the first table top is in its first generally centered position and the second table top is in its second generally centered position, a partition may be removably disposed between the first and second table tops such that the first table is disposed in a first room and the second table is disposed in a second room (with the partition forming a common or shared wall of the first and second rooms). When it is desired to combine or connect or join the table tops, the partition may be removed and the table tops may be moved to their extended positions, whereby the opposing ends of the table tops abut one another and the table tops cooperate to form a single table top spanning partially into each of the two "rooms".

Optionally, the first table top may comprise a first pattern or color and the second table top may comprise a second pattern or color, wherein the first and second patterns or colors generally correspond to one another at least at the opposing ends of the first and second table tops. The first table may include a joining element at the opposing end of the first table top, with the joining element being configurable to attach at the opposing end of the second table top when the opposing ends of the first and second table tops abut one another. The second table may also include such a joining element at the opposing end of the second table top.

Therefore, the present invention provides a table and table system that has a movable or adjustable or slidable table top that adapts the table for different applications. The table tops of two spaced apart tables may be moved towards one another to abut and form a larger table that may span two rooms or room portions and may be moved away from one another so that the tables are two separate stand-alone tables, whereby a partition may be provided between the two separate tables to establish separate rooms with a respective table disposed therein.

These and other objects, advantages, purposes and features of the present invention will become apparent upon review of the following specification in conjunction with the drawings.

BRIEF DESCRIPTION OF THE DRAWINGS

FIG. 15 is a plan view of two adjacent tables of the present invention, with the table tops moved away from one another to provide space between the table tops, such as for a room dividing wall or the like;

DESCRIPTION OF THE PREFERRED EMBODIMENTS

Figure 1:
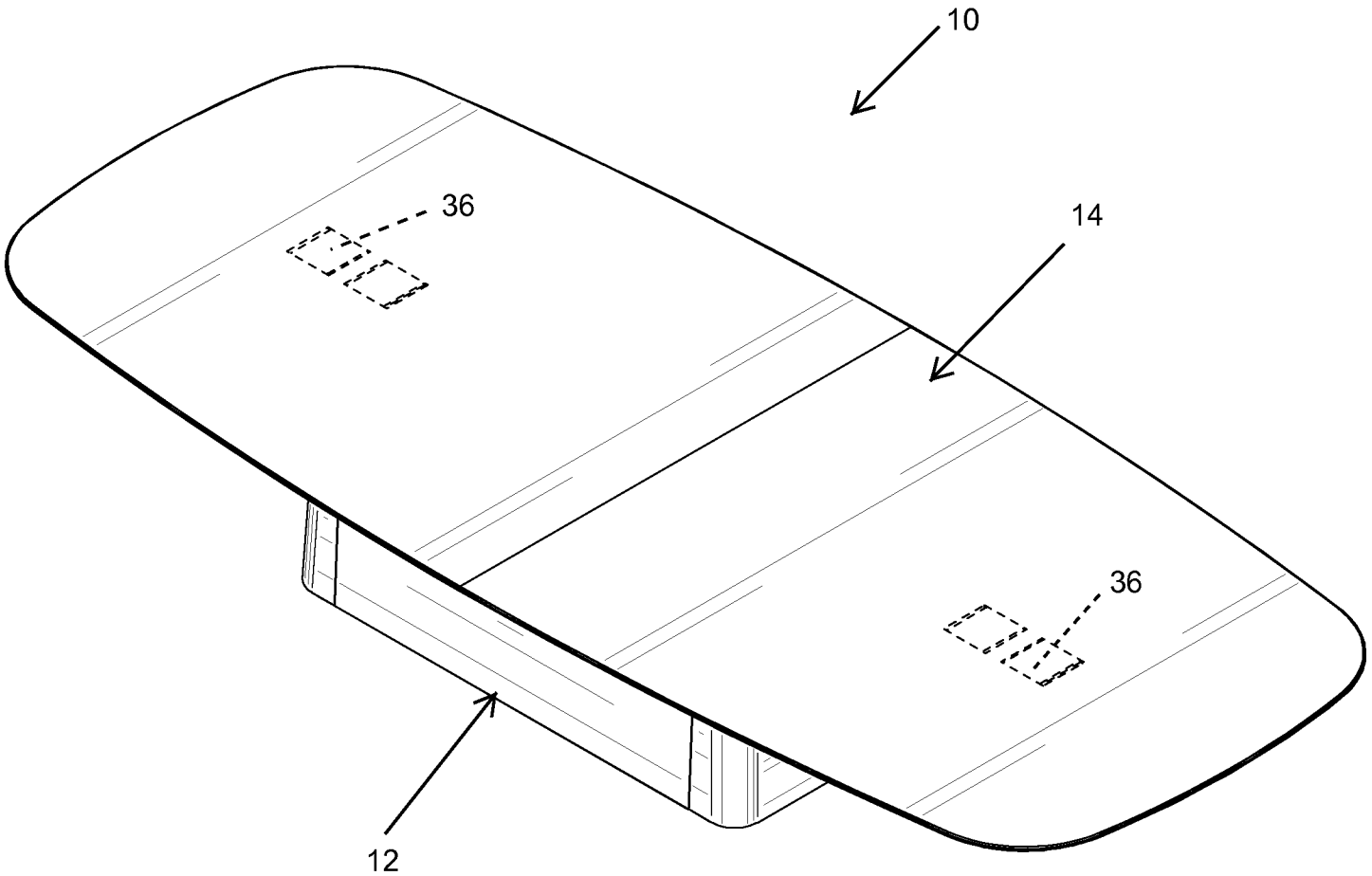
FIG. 1 is a perspective view of a table with adjustable top in accordance with the present invention, shown with its table top generally centered on its pedestal.
Figure 2:
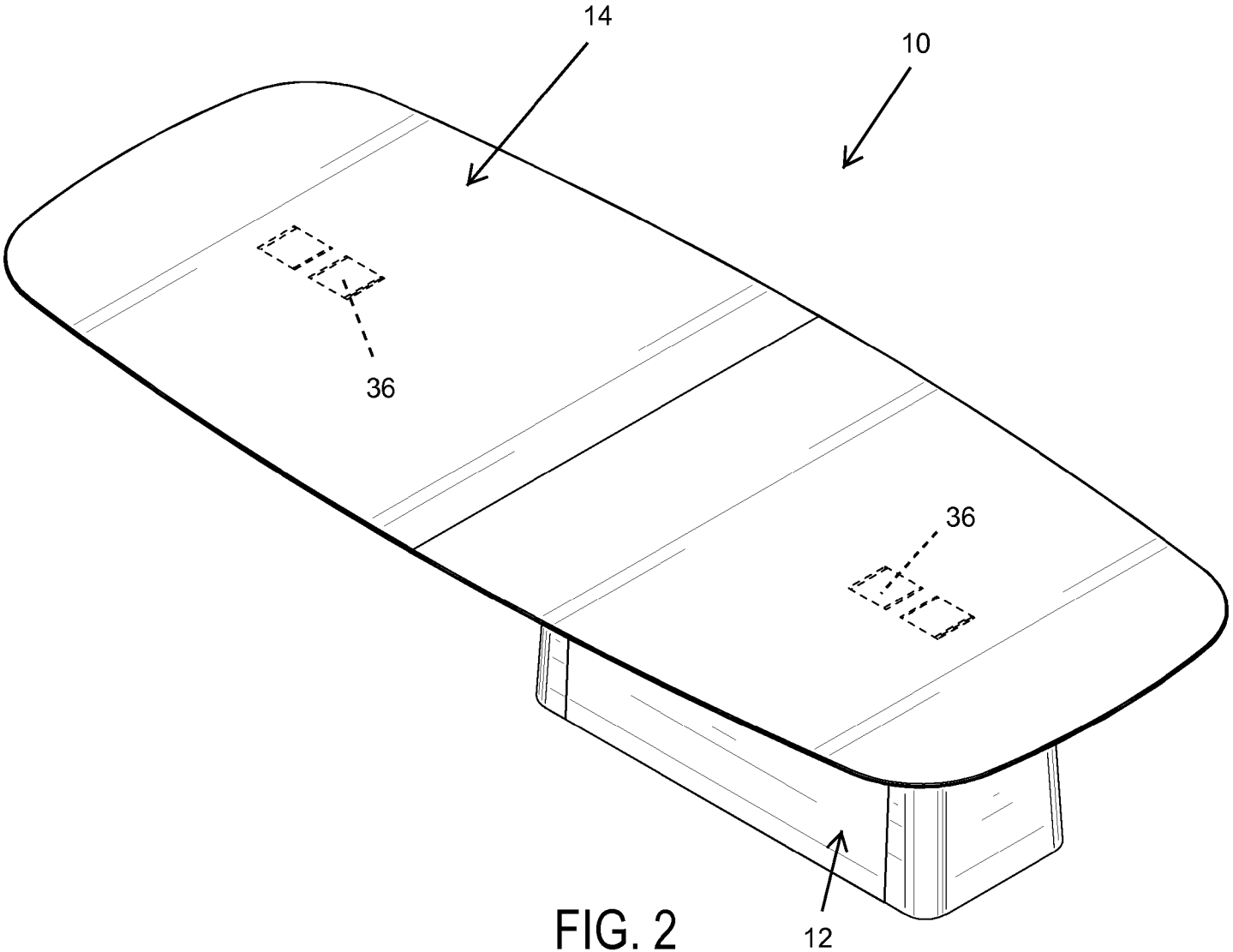
FIG. 2 is another perspective view of the table of the present invention, shown with the table top extended from one end of the pedestal.
Figure 3:
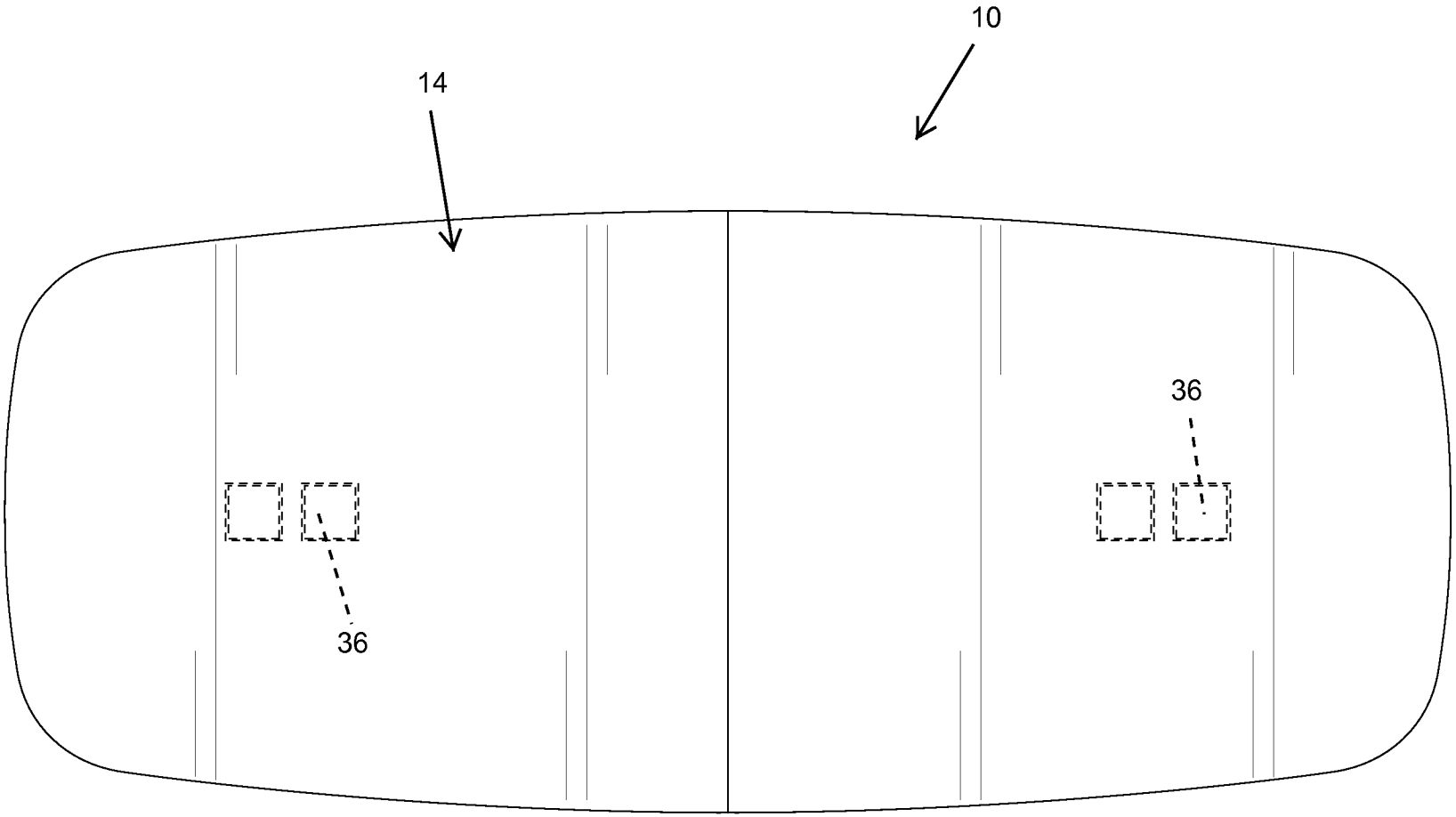
FIG. 3 is a top plan view of the table of FIG. 1.
Figure 4:
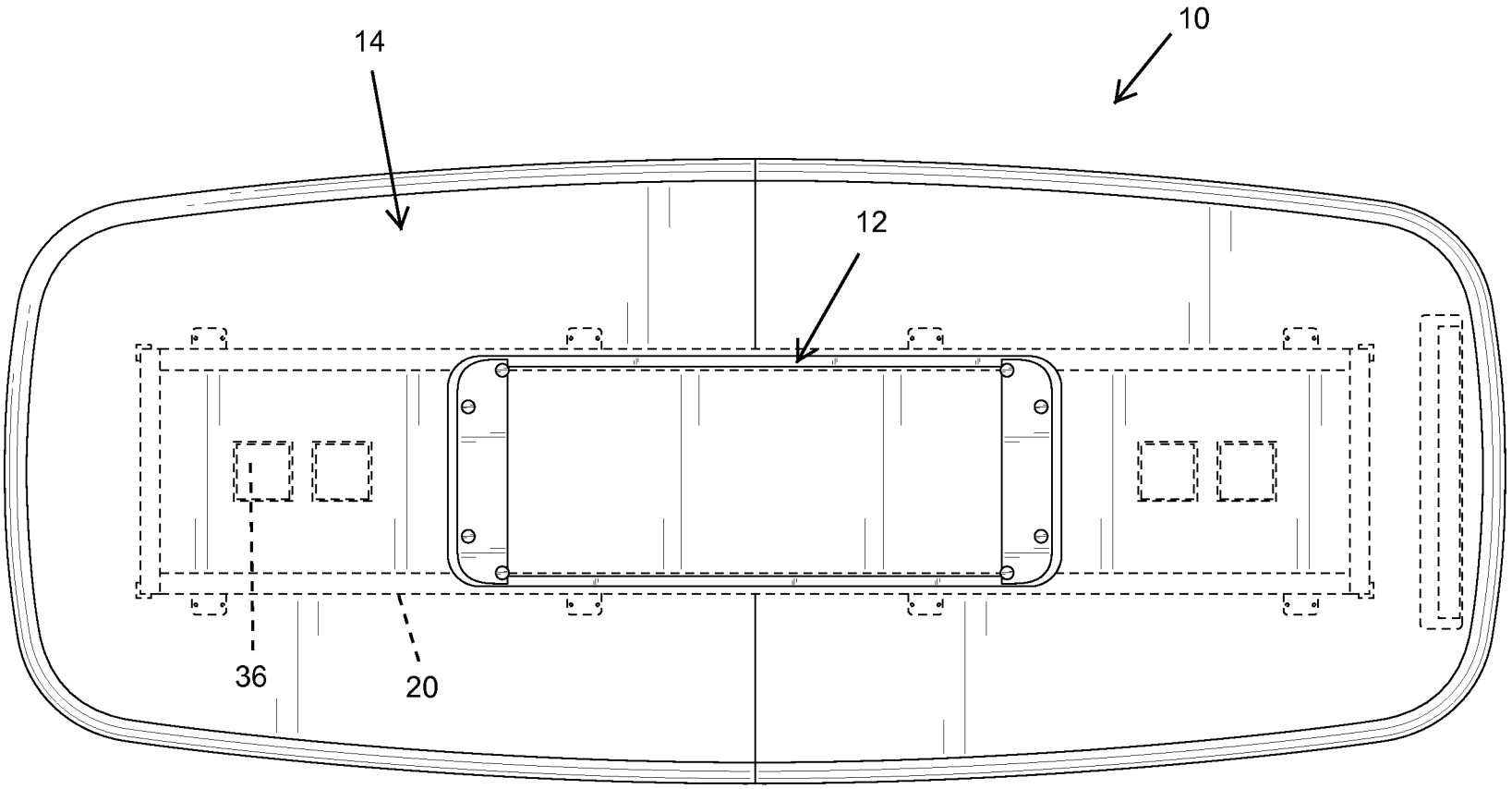
FIG. 4 is a bottom plan view of the table of FIG. 1.
Figure 5:
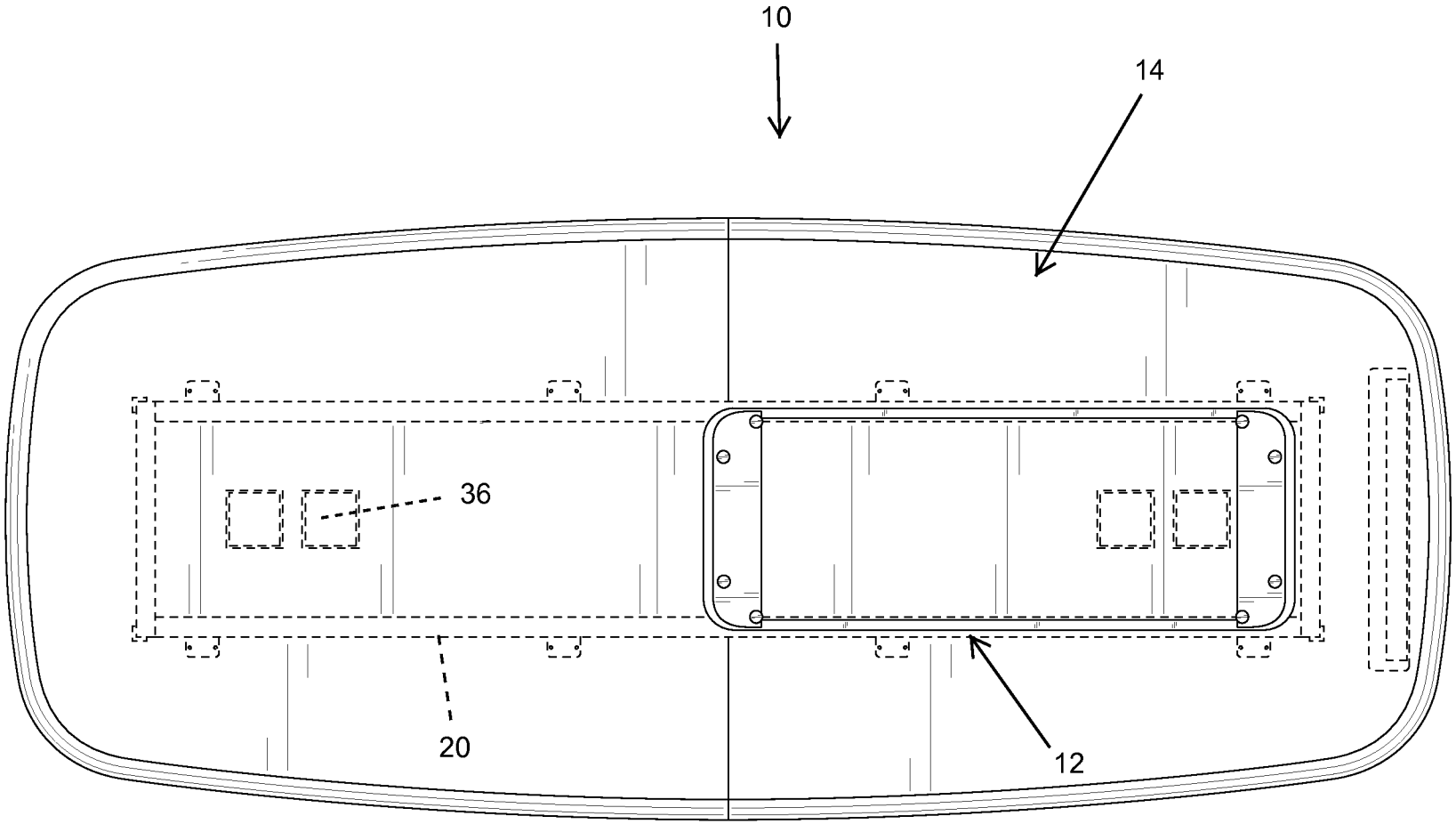
FIG. 5 is a bottom plan view of the table of FIG. 2.
Figure 6:
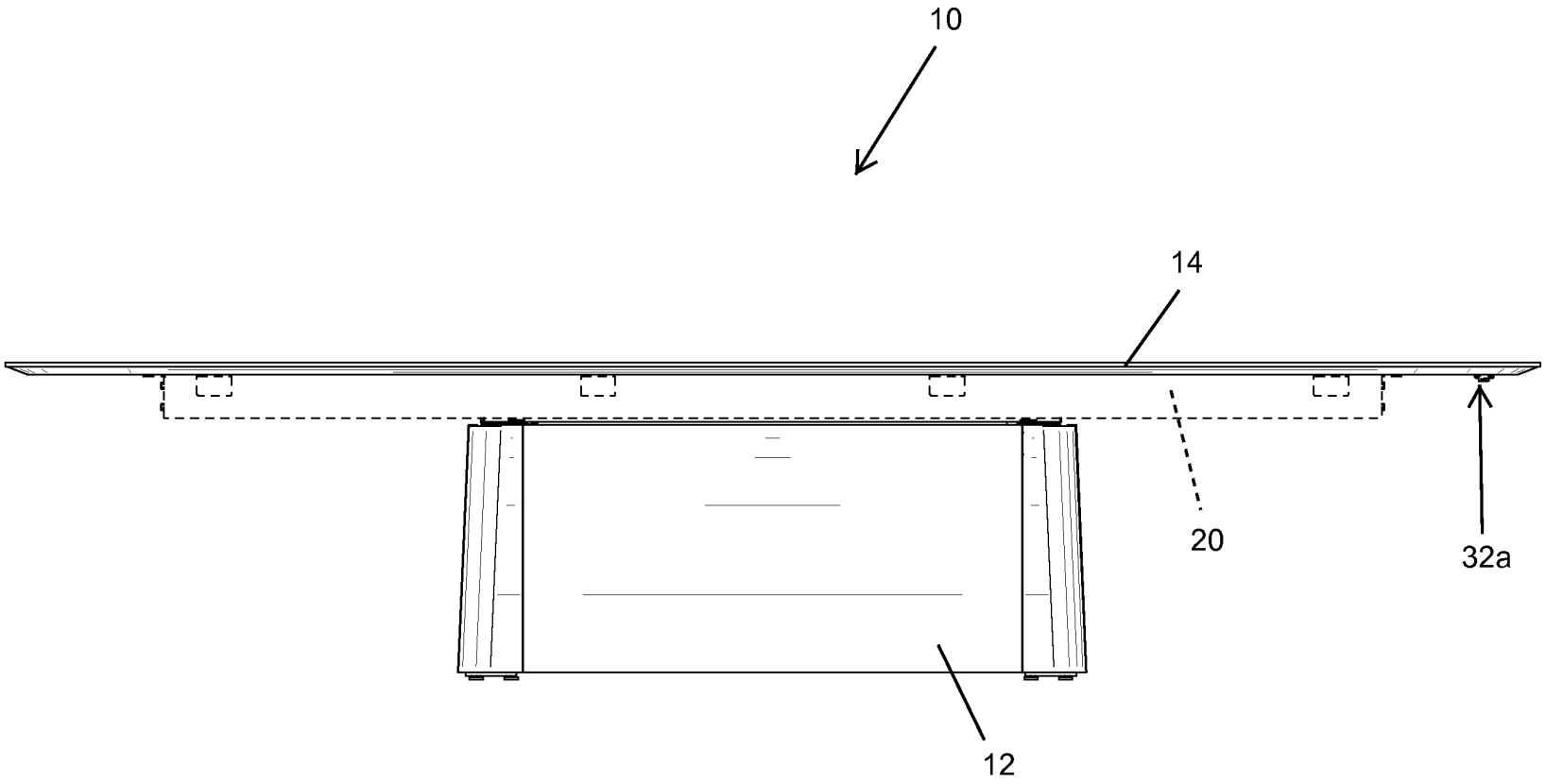
FIG. 6 is a side elevation of the table of FIG. 1.
Figure 7:
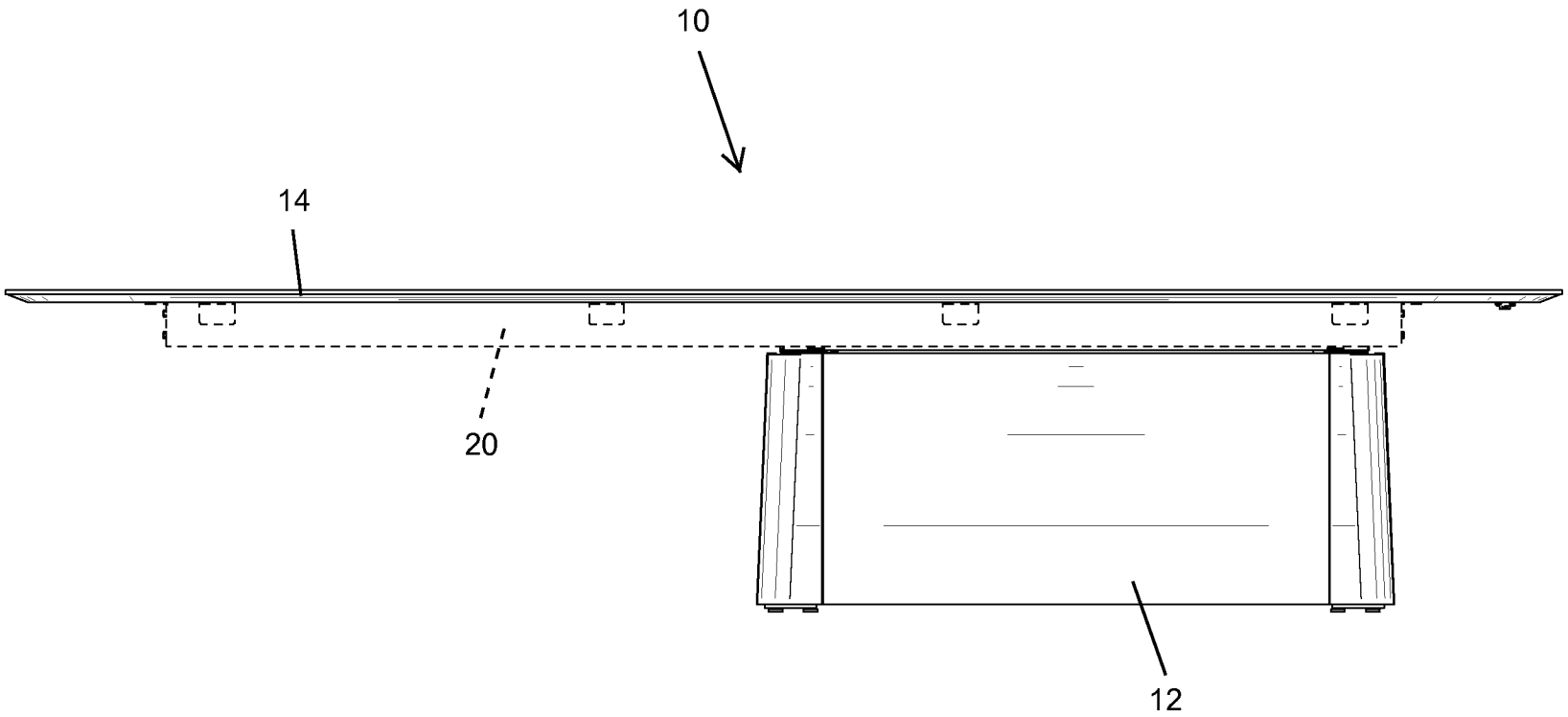
FIG. 7 is a side elevation of the table of FIG. 2.
Figure 8:
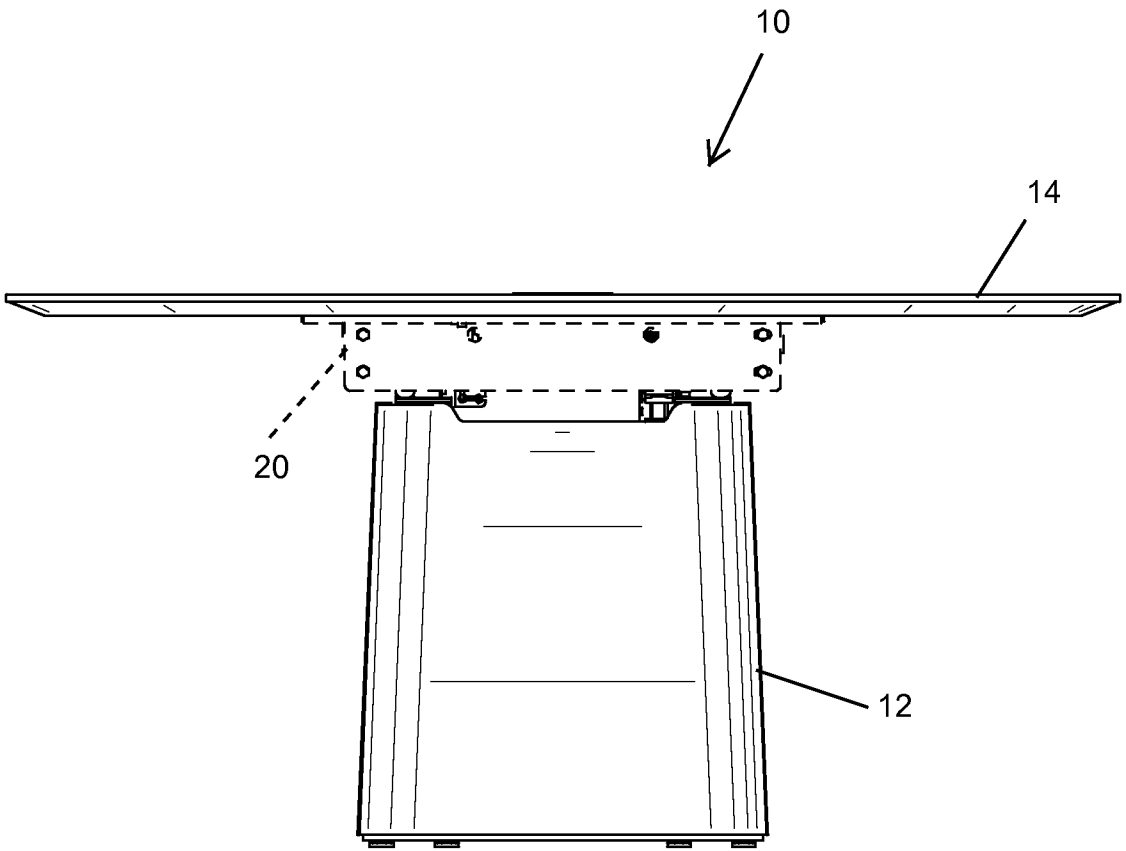
FIG. 8 is an end elevation of the table of FIG. 1.
Figure 9:
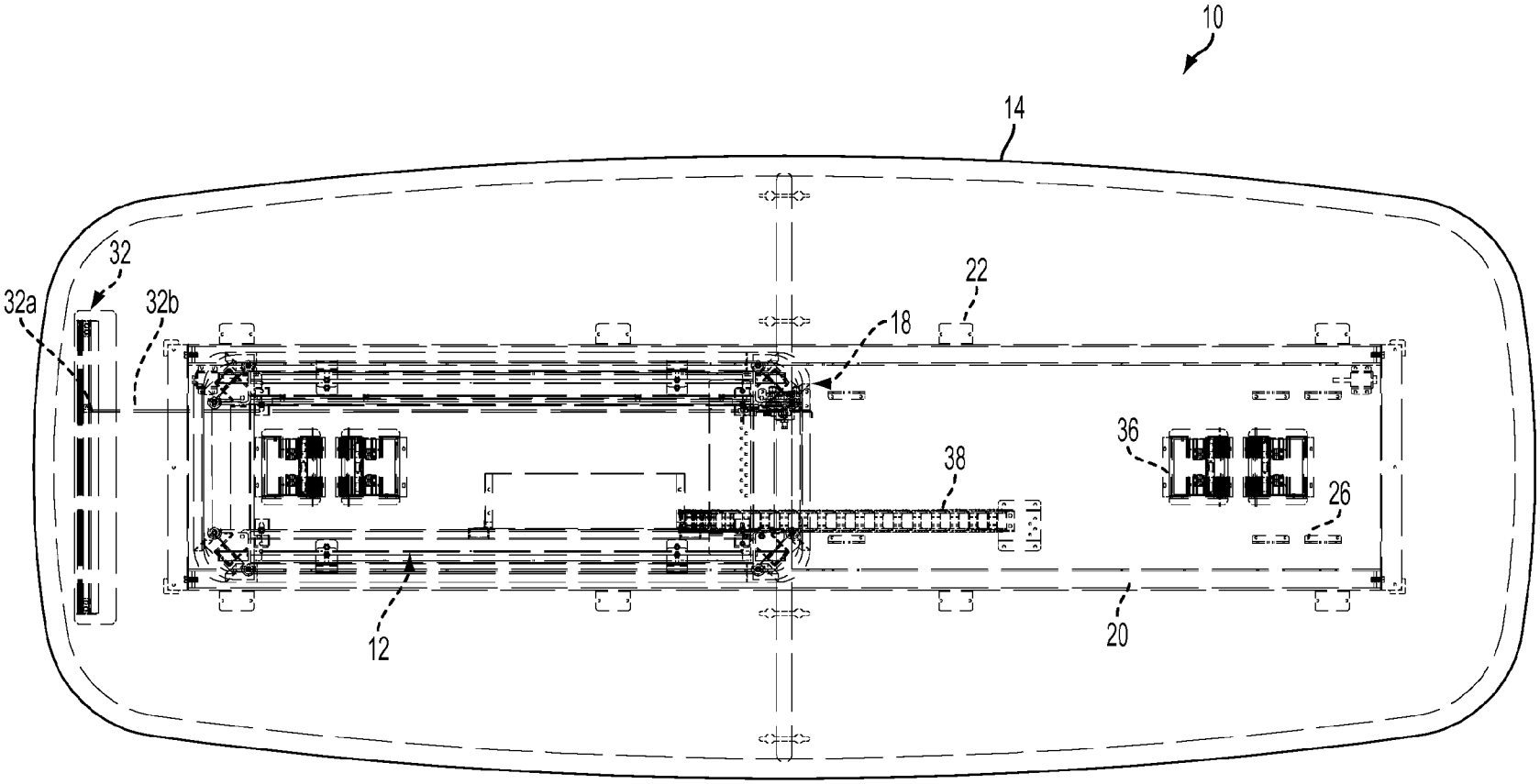
FIG. 9 is a plan view of the table of the present invention, shown with the adjustment and braking mechanisms and electrical systems in phantom, and shown with the table top extended towards one end such as in a similar manner as in FIG. 2.

Referring now to the drawings and the illustrative embodiments depicted therein, a conference table 10 includes a base or pedestal 12 and a table top 14 that is movably or adjustably or slidably disposed at the base 12 (FIGS. 1-8 and 14-20). The table top 14 thus may be moved from a generally centered position (FIGS. 1, 4 and 6), where the table top may be generally centered at the base 12, and an extended or off-centered position (FIGS. 2, 5 and 7), where the table top 14 is moved relative to the base 12 such that a portion of the table top 14 is extended from the base 12. The table top 14 is movable or slidable relative to the base 12 via a slide or roller mechanism 16 (FIG. 14), and the table 10 includes a braking mechanism or retaining or locking mechanism 18 to selectively retain the table top 14 relative to the base 12 at a desired location or degree of extension, as discussed below. The table 10 includes a flexible wire management system or element 38 that flexes in one direction to allow for flexing of the wiring and cables (that power and/or control various accessories at the table top) during adjustment of the table top relative to the base, as also discussed below. Two tables 10*a*, 10*b* (FIGS. 15-21) may be disposed near each other, whereby the respective table tops may be adjusted so that the table tops are spaced apart or so that the table tops abut or engage one another to provide a larger table top, as also discussed below. The table 10 may be made to look like the table disclosed in U.S. design patent application Ser. No. 29/423,932, filed Jun. 6, 2012, now U.S. Design Pat. No. D687,657, which is hereby incorporated herein by reference in its entirety. Although shown and described as being movable between a generally centered position and an extended position, clearly, the table top may be movable between a first extended position in one direction relative to the base and a second extended position in the other or opposite direction, with the generally centered position being between the two extended positions, without affecting the scope of the present invention.

Figure 14:
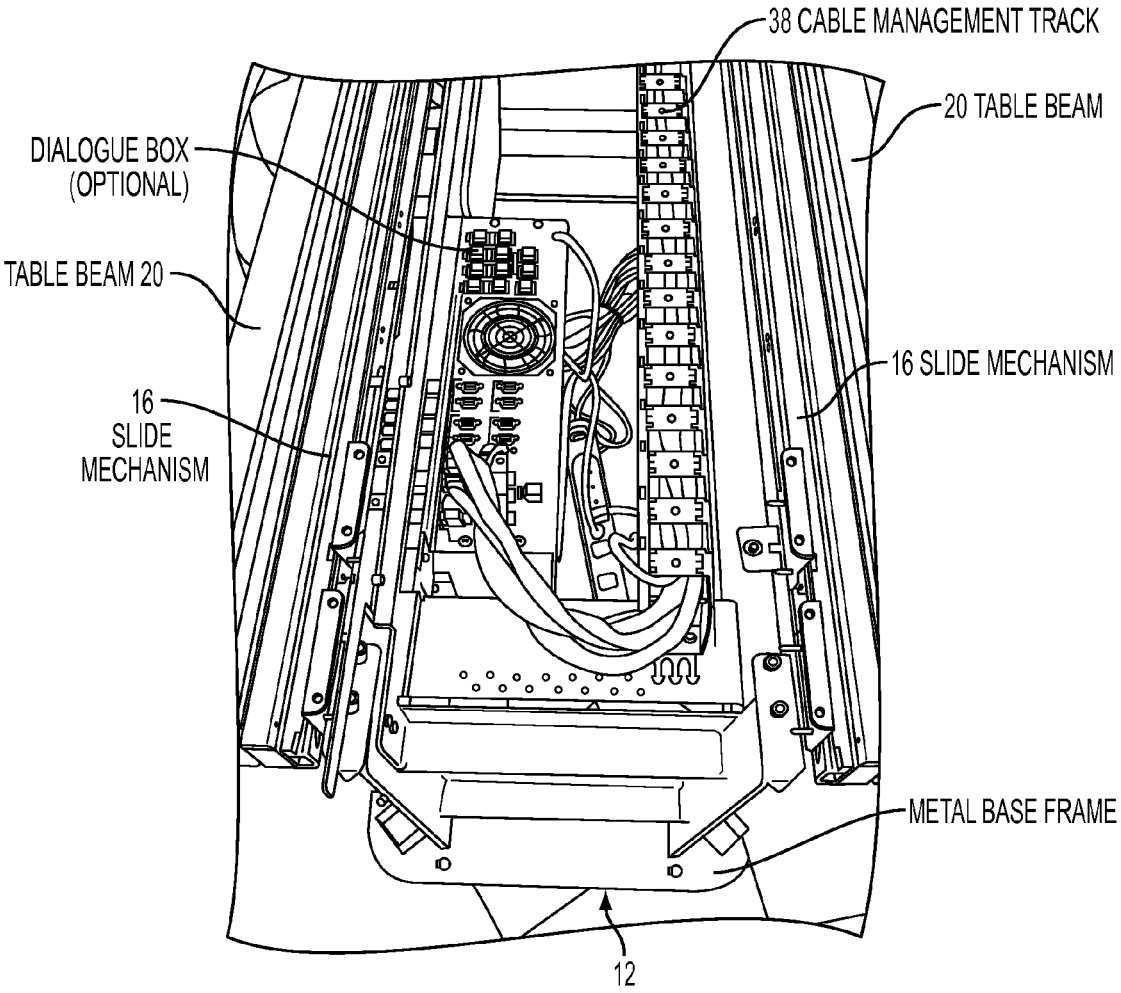
FIG. 14 is a perspective view of a portion of a table of the present invention, with the table top removed therefrom.

In the illustrated embodiment, base 12 of table 10 comprises a pedestal type base and is a single pedestal for supporting the table top 14. Base 12 may include an electrical connector or the like for connecting power wires and/or control wires to a power source and/or control or the like at the floor or support structure when the table is disposed at the floor or support structure. As shown in FIG. 14, the base may comprise a hollow pedestal that may be placed over one or more outlets or electrical ports or connectors at the floor, so that all electrical connections to the table 10 are made within the base or pedestal and are thus hidden from view. Although shown and described as a hollow pedestal, it is envisioned that the base may comprise any suitable base, such as an open base having legs or panels at opposite ends thereof, while remaining within the spirit and scope of the present invention. For example, an enclosed pedestal or base may be fully enclosed to provide the maximum interior capacity for even the most cable intensive environments, while a leg or panel base may provide a more open design when cable needs are less intense. Optionally, the base may comprise removable panels for easy access to the interior of the base, with the panels removably attached at a metal frame that provides structure for the base.

Because only the table top moves or slides while the base remains fixed, the table top of the table of the present invention can sometimes be in a highly cantilevered state relative to the base when the table top is at the extreme ends of its travel range. Therefore, the base of the table may be weighted and/or secured in place with floor anchors or the like, to limit tilting of the table when in its fully extended or substantially extended state. The result is a rigid structure capable of supporting the most demanding loads while still allowing for easy repositioning of the table top. In addition, the anchoring allows the base to be smaller in scale, providing more leg room for the users and creating a striking cantilevered design of the table top over the base.

Figure 10:
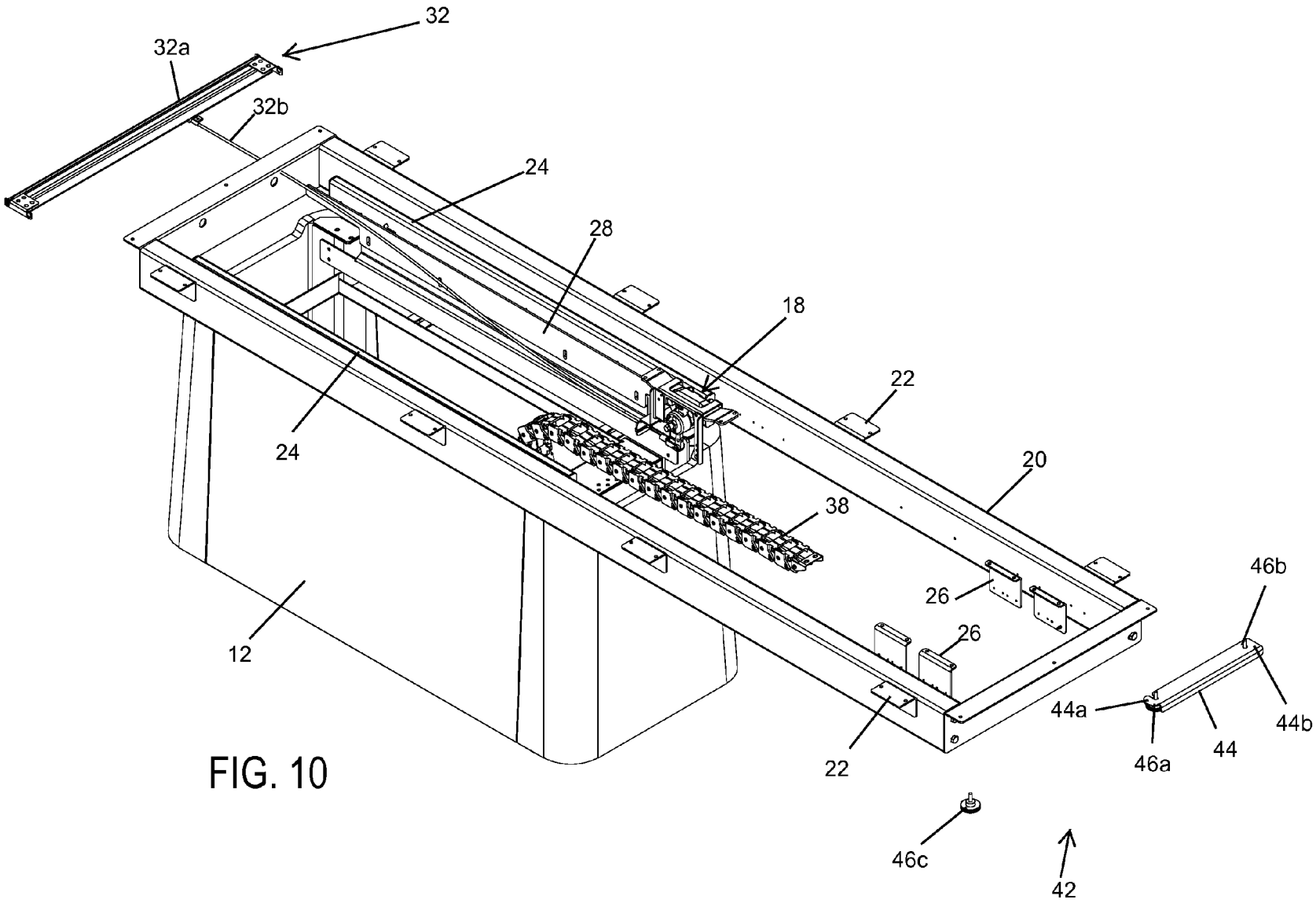
FIG. 10 is a perspective view of the table of the present invention, shown in its extended state and with the table top removed to show additional details.

Table top 14 is mounted to the base 12 in a manner that allows for selective movement or adjustment of the table top relative to the base, as discussed below. In the illustrated embodiment, table top 14 is fixedly attached to a carriage or support structure or frame 20, such as via a plurality of brackets 22. The table top 14 (or the support structure 20) is movably supported via the slide or roller mechanism 16, which has a base portion or receiving portion mounted along a pair of rails 24 disposed at an upper region of the base 12, and a slide or roller element (having a plurality of rollers or bearings disposed therealong) mounted at brackets or supports 26 attached to an underside of the table top 14 (such as at the opposite end regions of the support structure 20 and at a generally central region of the support structure 20). The roller or slide element moves along and at least partially within the receiving or base element at the respective rail 24 and the slide mechanism (which may be similar to drawer slides and the like known in the furniture art) provides moving support of the table top and limits tipping or tilting of the table top when in its extended position. For example, when the table top and support structure 20 are in the extended position as shown in FIG. 10, the slide or roller elements at or near brackets 26 at the extended end of the table top are not engaged with the base slide or channel elements at the rails 24, while the roller elements at or near the opposite end of the table top and support structure would be within the channel or rails and would limit or substantially preclude upward movement of the opposite end of the table top so as to cantileverly support the table top in its extended position. The roller elements at the center region of the table top and support structure would also be within the respective channels or rails and would limit downward movement of the table top when in its extended position.

Thus, the table top and support structure 20 are free to slide or roll or move relative to the rails 24 of the base 12 to position the table top at a desired position relative to the base. When the table top is so positioned, the braking mechanism 18 is actuated to retain the table top 14 relative to the base 12. The table may include stop elements to mechanically stop or limit extension at a selected or appropriate degree of extension. Optionally, the stop elements may be adjustable (such as adjustably or selectively mounted at a desired location along the table top) to limit movement of the table top relative to the base in either direction at a selected position or degree of extension, such that the degree of extension may be set depending on the particular application of the table and clearance at the ends of the table in the room in which it is installed.

In the illustrated embodiment, braking mechanism 18 comprises a braking rail or element or member 28 disposed along the base 12 and a braking device or clamping device 30 attached at the underside of the table top 14 (such as via brackets 31) and movable with the table top and along the braking rail 28. The braking device 30 may be biased to its engaged or locking position or state, and may be released by an operator actuating a release lever or input element 32 (such as at an underside of the table top and at or near one of the ends of the table top) to release the brake and to allow movement of the table top relative to the base to the desired location. When the table top is at the desired location or position relative to the base (such as centered or fully extended in either direction or any location therebetween), the operator may release the input element 32, whereby the braking device 30 engages the braking rail 28 to frictionally retain the table top relative to the base at the desired or selected position.

Figure 11:
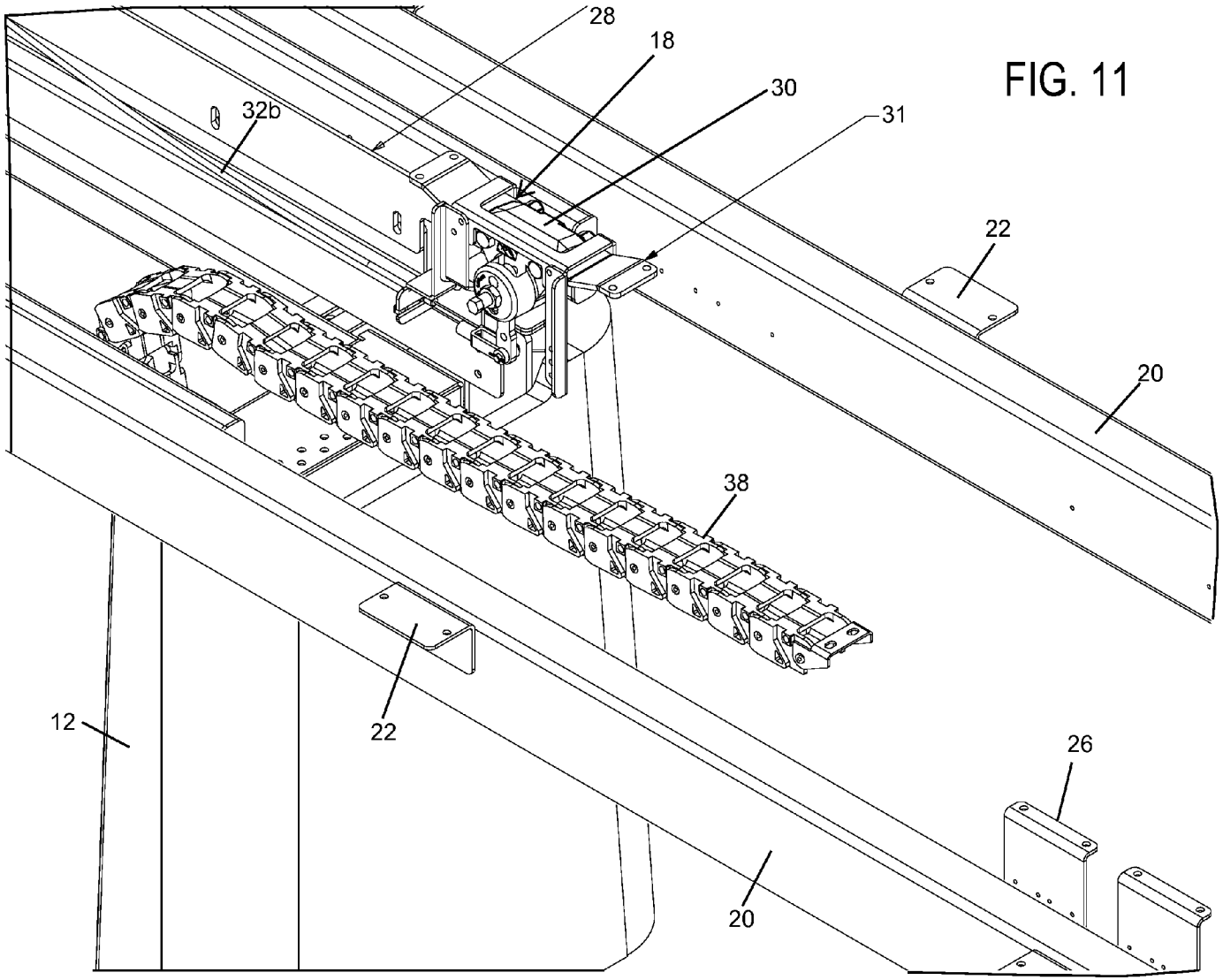
FIG. 11 is an enlarged perspective view of a portion of the table of FIG. 10.
Figure 11A:
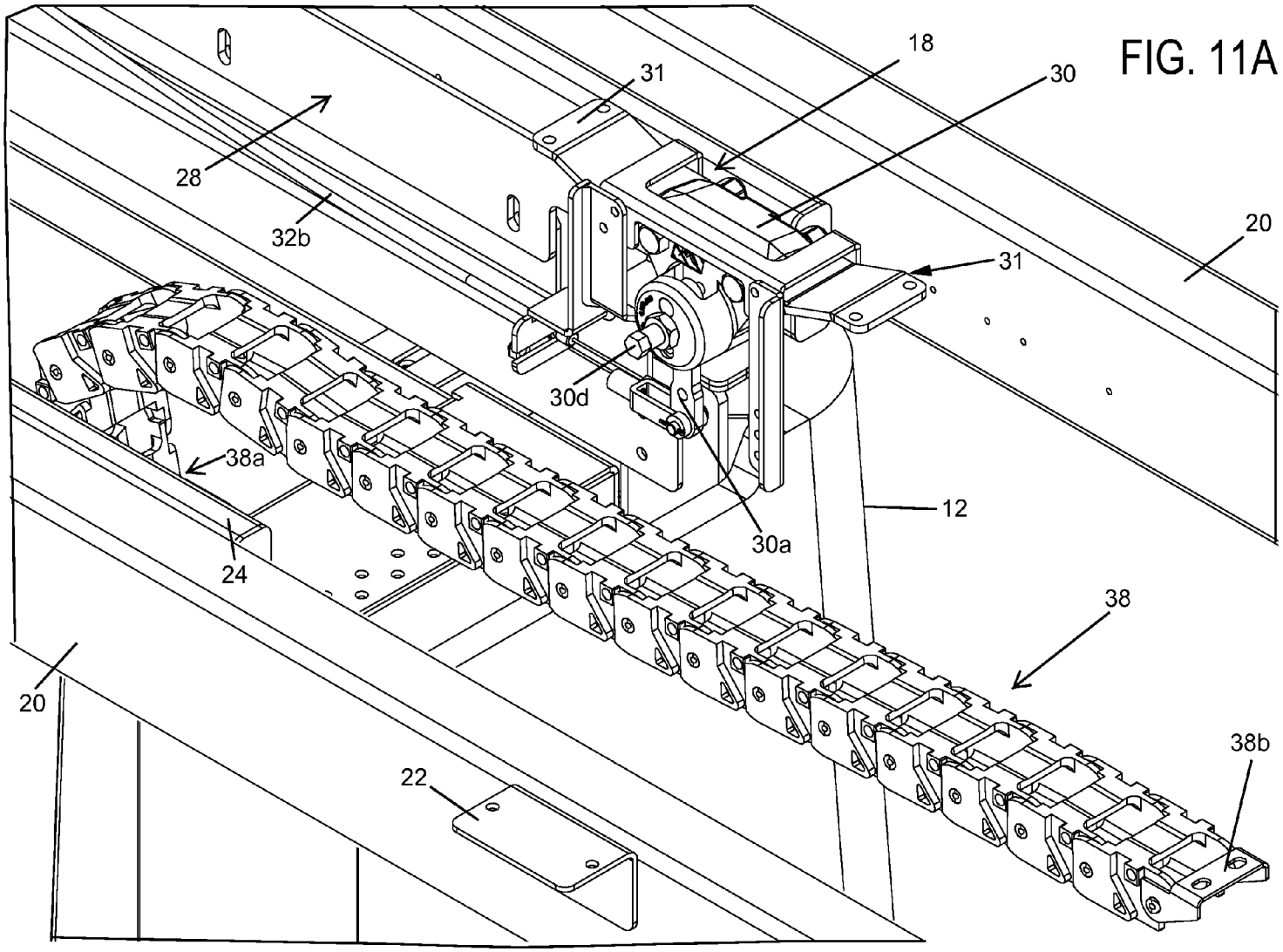
FIG. 11A is a further enlarged perspective view of a portion of the table of FIG. 10.
Figure 12:
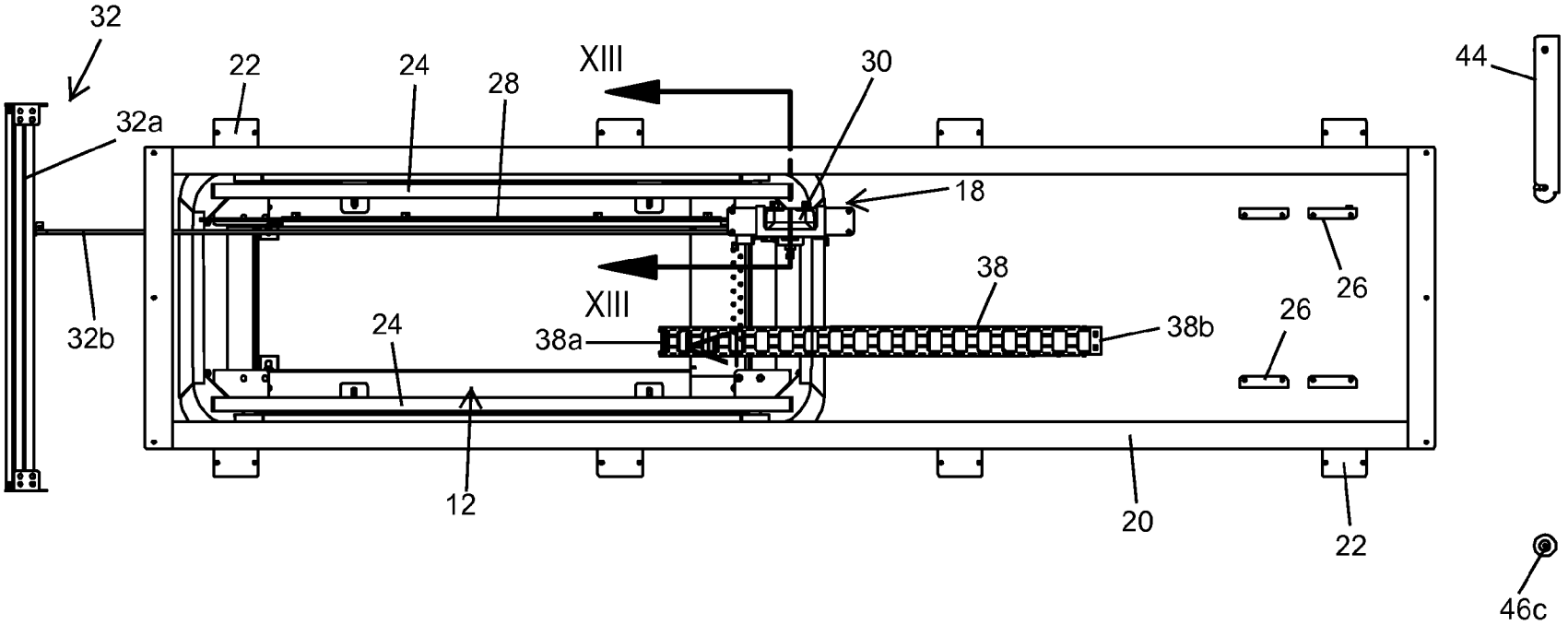
FIG. 12 is a plan view of the table of FIG. 10.
Figure 13:
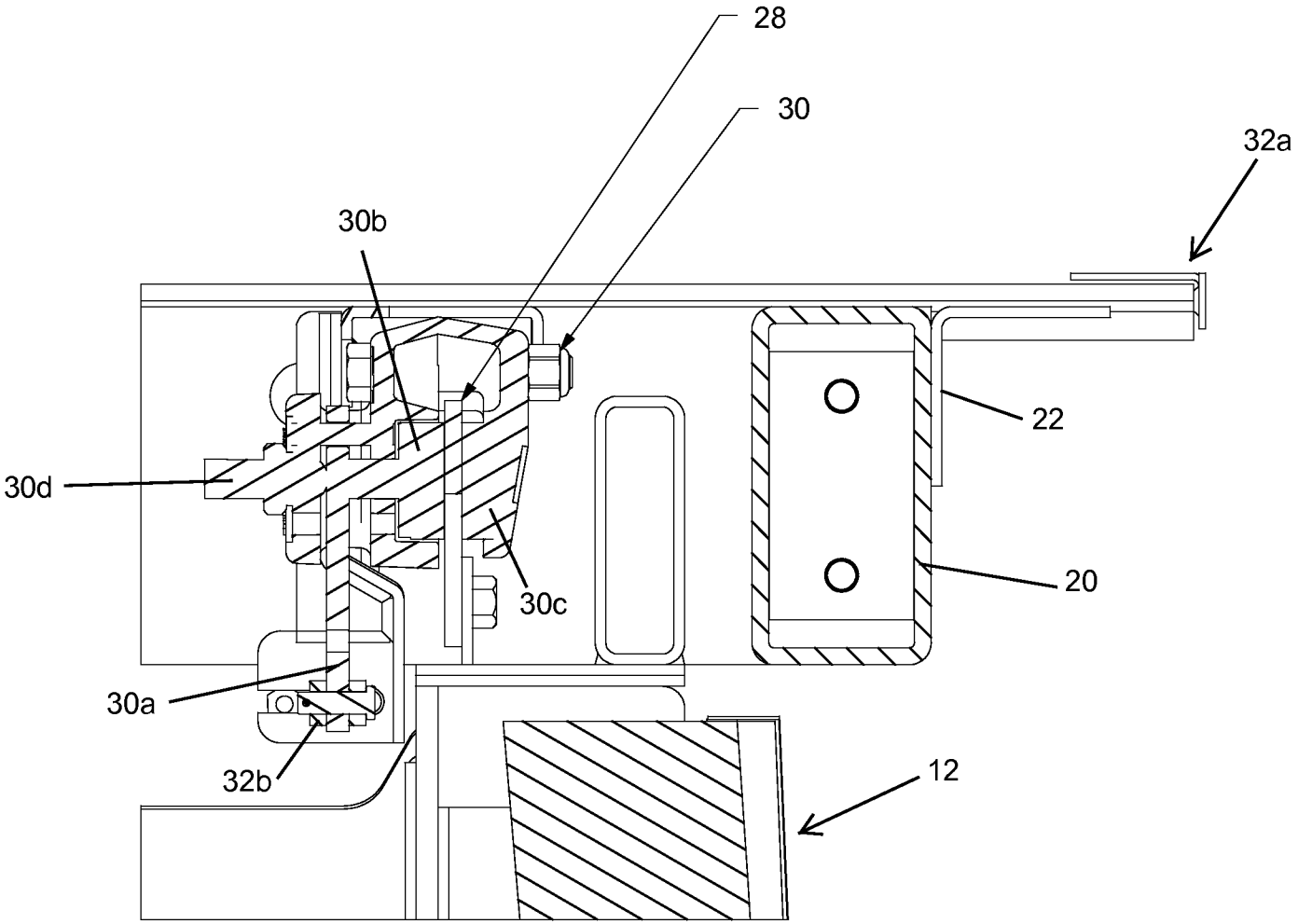
FIG. 13 is a sectional view taken along the line XIII-XIII in FIG. 12.

In the illustrated embodiment, and as best shown in FIGS. 9, 10, 11, 11A and 13, the user input element 32 comprises a lever 32*a* and a cable 32*b* (such as a sheathed cable having a sheath and an inner cable within the sheath, whereby the sheath is fixed at both ends and pulling of the inner cable at one end imparts a similar movement of the inner cable at its other end), where movement of the lever 32*a* by the operator (such as via downward pivoting of a lever or handle about a generally vertical or horizontal pivot axis or lateral or longitudinal movement or pivoting of a lever or handle about a generally vertical or horizontal pivot axis or any other suitable lever or arm or cable end movement) may pull at the cable 32*b* to release the braking device 30. As shown in FIGS. 11 and 11A, the cable 32*b* is attached to a lever 30*a* of braking device 30, whereby pulling at the lever 30*a* (via an operator actuating the user input 32*a*) imparts a pivotal movement of lever 30*a* to release the brake. As shown in FIG. 13, braking device 30 comprises a brake caliper that receives the braking rail 28 therein. The brake caliper is biased such that both arms or elements 30*b*, 30*c* of the caliper engage the braking rail 28 and clamp the braking rail 28 therebetween. When the lever 30*a* is pulled and pivoted about its pivot shaft or axle 30*d*, this imparts rotational movement of caliper element 30*b*, which moves caliper element 30*b* away from the braking rail 28 (such as via rotating along a threaded shaft 30*d*) to disengage the braking device 30. When disengaged, the table top (and support structure 20 and braking device 30) may be moved relative to the base 12 and the braking rail 28. When the lever is released, the biasing of the caliper causes the caliper to clamp onto the rail, thereby limiting or substantially precluding movement of the table top relative to the base at that position.

Thus, a user or operator may actuate the user input lever 32*a* to release the braking device 30 to allow the operator to adjust or move the table top 14 relative to the base 12 to set the table top to a desired or selected position relative to the base. When the table top is at the desired or selected position, the operator releases the user input lever 32*a*, and the braking device 30 returns to its braking state to secure or retain the table top 14 relative to the base 12. Although shown and described as having the braking device attached at the table top and movable with the table top along a braking rail that is attached at the base, clearly, the braking device may be fixedly disposed at the base, with the braking rail attached at the underside of the table top, while remaining within the spirit and scope of the present invention. Also, although shown and described as comprising a clamping or caliper braking device actuated by a cable, clearly, other means for braking or retaining the table top relative to the base may be implemented (such as a braking device that is actuated to mechanically retain the table top relative to the base or to release the retaining or braking means via an electrical actuator or the like), while remaining within the spirit and scope of the present invention.

The table 10 optionally, and desirably, includes one or more electrical outlets and data ports 36 disposed at the table top 14. For example, and as shown in FIGS. 1-5, 9, 15, 17, 18, 20 and 21, one or more outlets and data ports 36 may be disposed at or near opposite end regions of the table top 14, such that they are readily accessible to a person sitting at the table 10. The outlets and data ports 36 are electrically connected to a power source and data source or internet connection or the like (that may be at the base 12 or at the floor or support structure at which the base is disposed) via one or more cables that are routed and guided in a flexible cable management element or track 38. In the illustrated embodiment, the flexible cable management element 38 comprises a linked element having a plurality of pivotally joined links that allow for flexing of the element 38 (and the electrical and data cables or wires disposed therein or therealong) in one direction while limiting or substantially precluding flexing of the element 38 in another direction (such as in another direction that is generally transverse or normal to the first or flexing direction). Thus, and as can be seen in FIGS. 9-12 and 14, one end 38*a* of the element 38 is fixed at the base 12 and another end 38*b* of the element 38 is fixed at the underside of the table top 14 (or may be fixed at the support structure 20), whereby the track or element 38 guides the cables as the table top is moved relative to the base, and guides them in a controlled manner to limit or substantially preclude bending or twisting or tangling of the cables as the table top is moved relative to the base.

The electrical power wires and data wires that extend from the end 38*b* of track or element 38 may be routed along the underside of the table top to the respective outlets and/or data ports 36, such as via any suitable retaining or guiding means. Optionally, the table 10 may include other electrical accessories at or near the outlets and data ports 36 or in place of one or more of the outlets and data ports 36, in order to provide the desired electronic features to the users of the table. For example, the table may include communication devices or audio/video components or devices, such as microphones and/or the like, disposed at the table top and electrically connected to a power source and/or control at the base of the table and/or at the floor or support structure at which the table is disposed. The table may utilize aspects of the tables described in U.S. Pat. No. 8,096,244 and/or U.S. patent application Ser. No. 13/113,356, filed May 23, 2011; and/or Ser. No. 10/858,724, filed Jun. 2, 2004 and published Dec. 8, 2005 as U.S. Publication No. US-2005-0268823, which are hereby incorporated herein by reference in their entireties.

Figure 22:
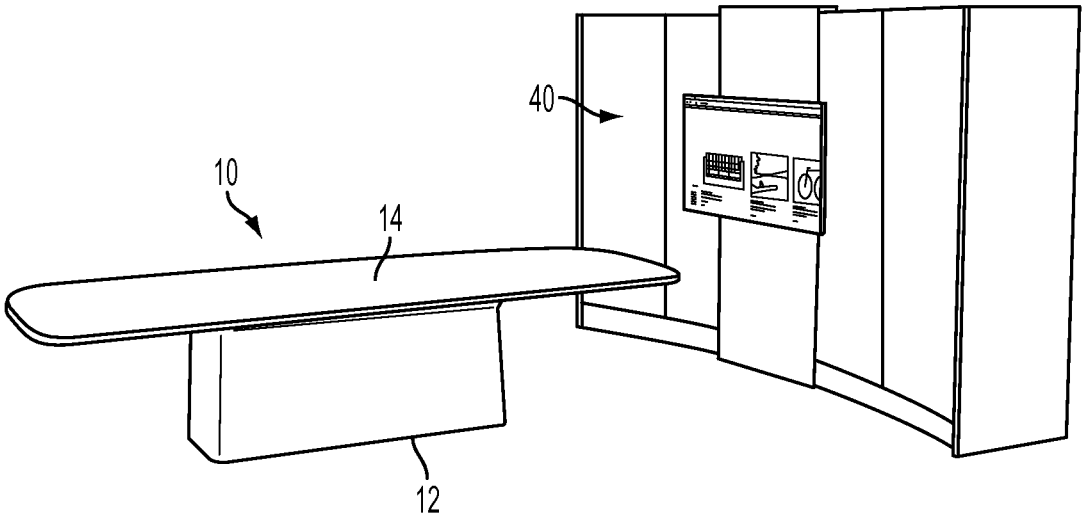
FIG. 22 is a perspective view of a table of the present invention positioned near a display panel.
Figure 23:
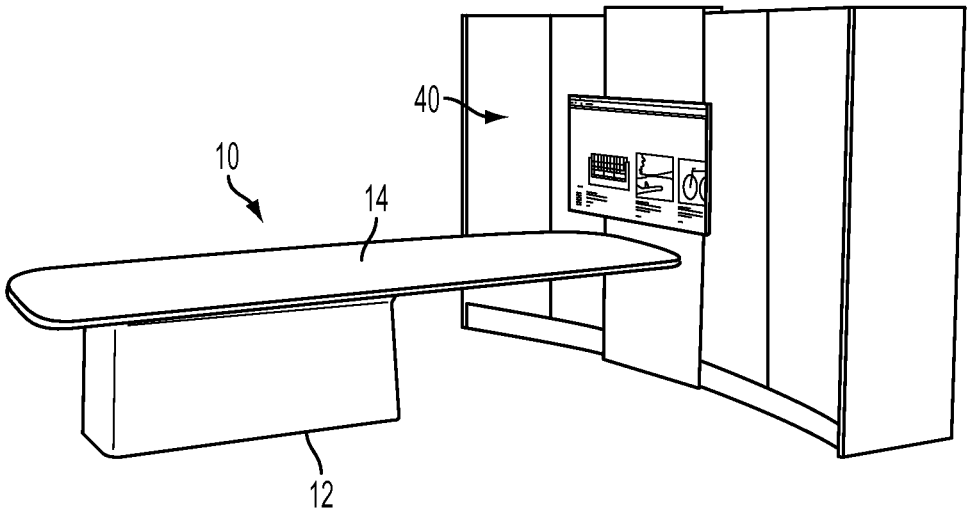
FIG. 23 is a perspective view of the table of FIG. 22, with the table top in its extended position to extend towards the display panel in accordance with the present invention.

Thus, the table of the present invention provides an adjustable table top that is movable relative to the base or pedestal of the table. Thus, when the table is positioned in a conference room or other type of room, the table top may be adjusted relative to the base to provide the desired layout or furniture arrangement for a particular meeting or the like, without having to physically lift and move the table itself (which may be very heavy such that such lifting and moving would be difficult to accomplish). For example, and with reference to FIGS. 22 and 23, the table 10 may be disposed in a room near a wall display or display structure 40 (which may provide video displays or the like for people to view during a meeting). If it is desired to have seating substantially around the entire table top, the table top may be centered at the base, such as shown in FIG. 22. However, if desired, the table top may be extended or moved towards the display structure 40, such as for supporting other display items or the like at or near the display structure or for allowing people sitting at the opposite end of the table to move closer to the display structure for enhanced viewing of the display or the like. Such an adjustment may be readily made by a single person to provide a different seating arrangement and enhanced meeting capabilities (depending on the type of meeting and desired room layout) without requiring any physical lifting and moving of the entire table (and thus also avoids any potential problems with wiring connections made at the base of the table). Optionally, it is envisioned that two divided room portions of a large room may have tables disposed therein with a display structure or wall display at opposite ends of the large room, whereby each table may be adjusted such as shown in FIGS. 22 and 23 (with the table tops extending in opposite directions towards their respective display walls), such that a dividing wall may be disposed between the tables to establish two separate conference rooms or the like, and, when the dividing wall or partition is removed, the table tops may be moved in the opposite direction (with the table tops extending towards one another) to abut one another and form a larger table in the expanded or joined conference room, such as in a similar manner as discussed below. Optionally, and depending on the table configuration and room size and design, the table may be configured and positioned so that it may only extend towards a wall display (such that extension in the opposite direction may be limited or may not move the table towards anything in particular) or the table may be configured and positioned so that it may extend (when the divider wall is removed) towards a table in another room (such that extension in the opposite direction may be limited or may not move the table towards anything in particular), or optionally, a table may be configured and positioned to selectively extend in either direction, such as in one direction towards a wall display (or another table or the like) and another direction towards another table (or another wall display or the like), while remaining within the spirit and scope of the present invention.

Figure 15:
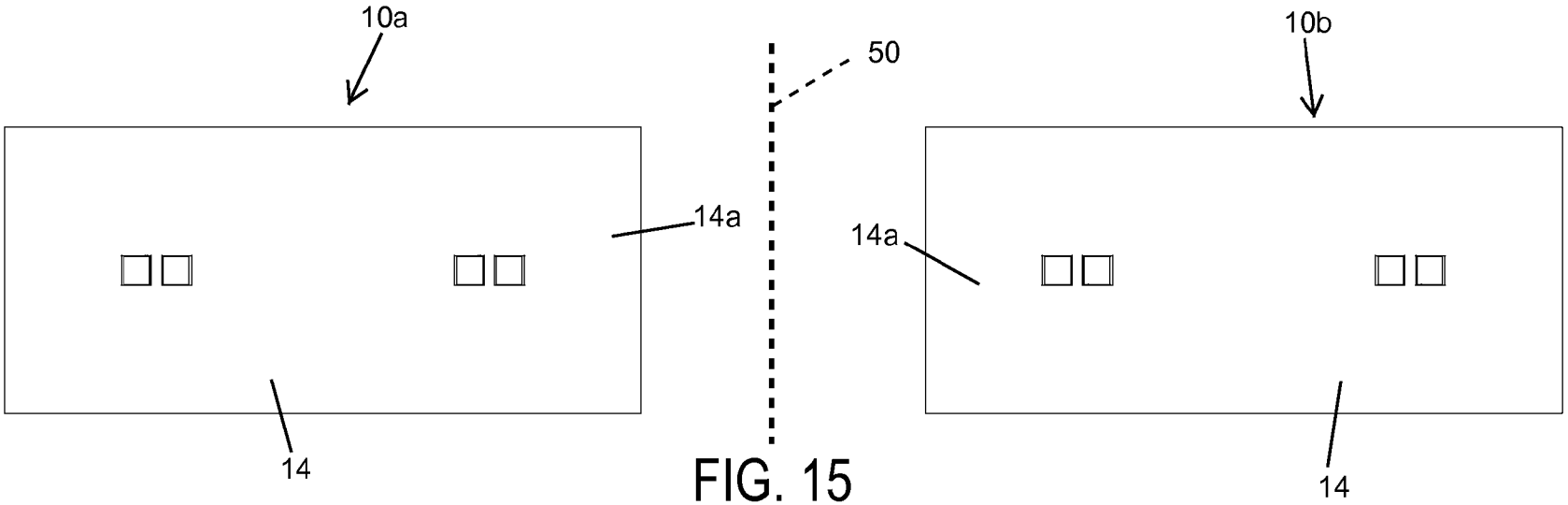
Figure 16:
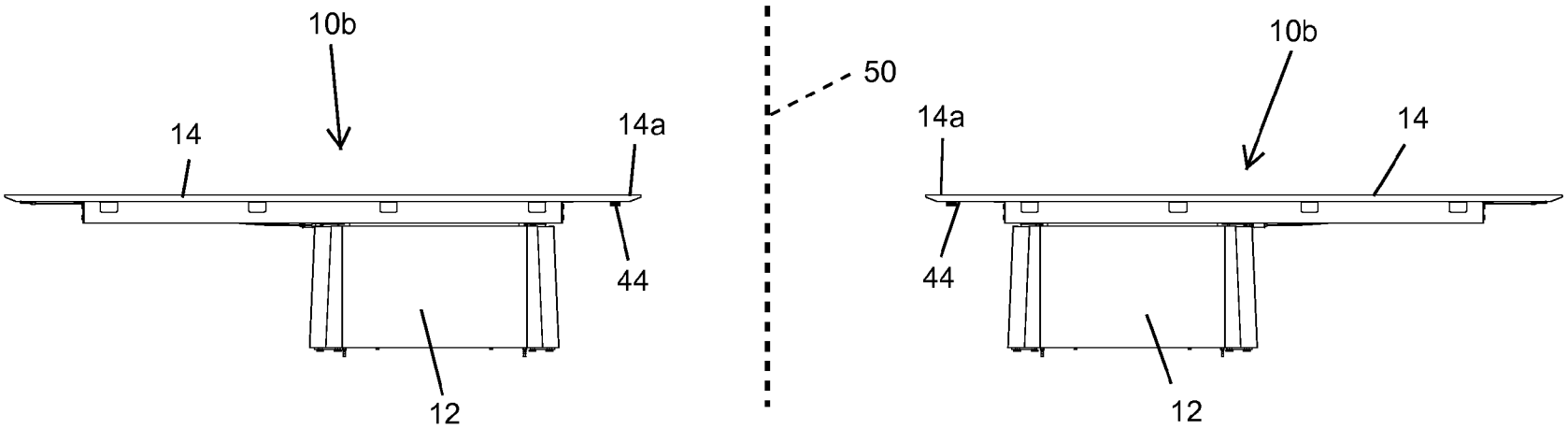
FIG. 16 is a side elevation of the tables of FIG. 15.

Optionally, and as can be seen with reference to FIGS. 15-21, a table system 42 may include two tables 10*a*, 10*b* disposed generally near one another and with a longitudinal axis of the table tops generally aligned with one another. The two tables may be disposed in a single room and a divider wall or partition 50 may be removably disposed between the tables. Thus, when the table tops 14 of the tables 10*a*, 10*b* are either generally centered on their respective bases 12 or adjusted so that the table tops are extended away from the other table (such as shown in FIG. 16), the opposed ends 14*a* of the table tops 14 are substantially spaced from one another. When the tables are arranged in this manner, there is walking and/or sitting space between the tables and such that a divider wall (such as an accordion type divider wall or partition that is movably attached at a ceiling or support structure and/or floor of a room) can be moved into place between the tables to divide the room into two separate rooms, each with its own respective table.

If it is desired to have a single, larger table in a single room (such as for a larger meeting involving several people), the divider wall 50 may be removed from between the tables 10*a*, 10*b* and the table tops 14 may be moved (via an operator at each table actuating the release lever 32*a* at the outer end 14*b* of the table top 14 to release the braking mechanism for that table) towards one another until their opposed ends 14*a* generally abut one another, such as shown in FIGS. 18-21. In such a configuration, the table tops are joined together to form a larger single table top for increased seating around a single table. Although shown and described as being abutted when both table tops are extended fully towards the other table top, clearly it is within the scope of the present invention that the table tops may be abutted when each table top is partially extended towards the other and/or when only one table top is extended towards the other (wherein the other table top may be in its centered position), depending on the spacing between the tables and the particular application of the tables. When the table tops are abutted together, a joining means 42 may be deployed to join and attach the abutted ends 14*a* of the table tops 14 together to retain the table tops in a tightly abutted arrangement to give the impression that the table tops comprise a single unitary table top of a single table.

Figure 21:
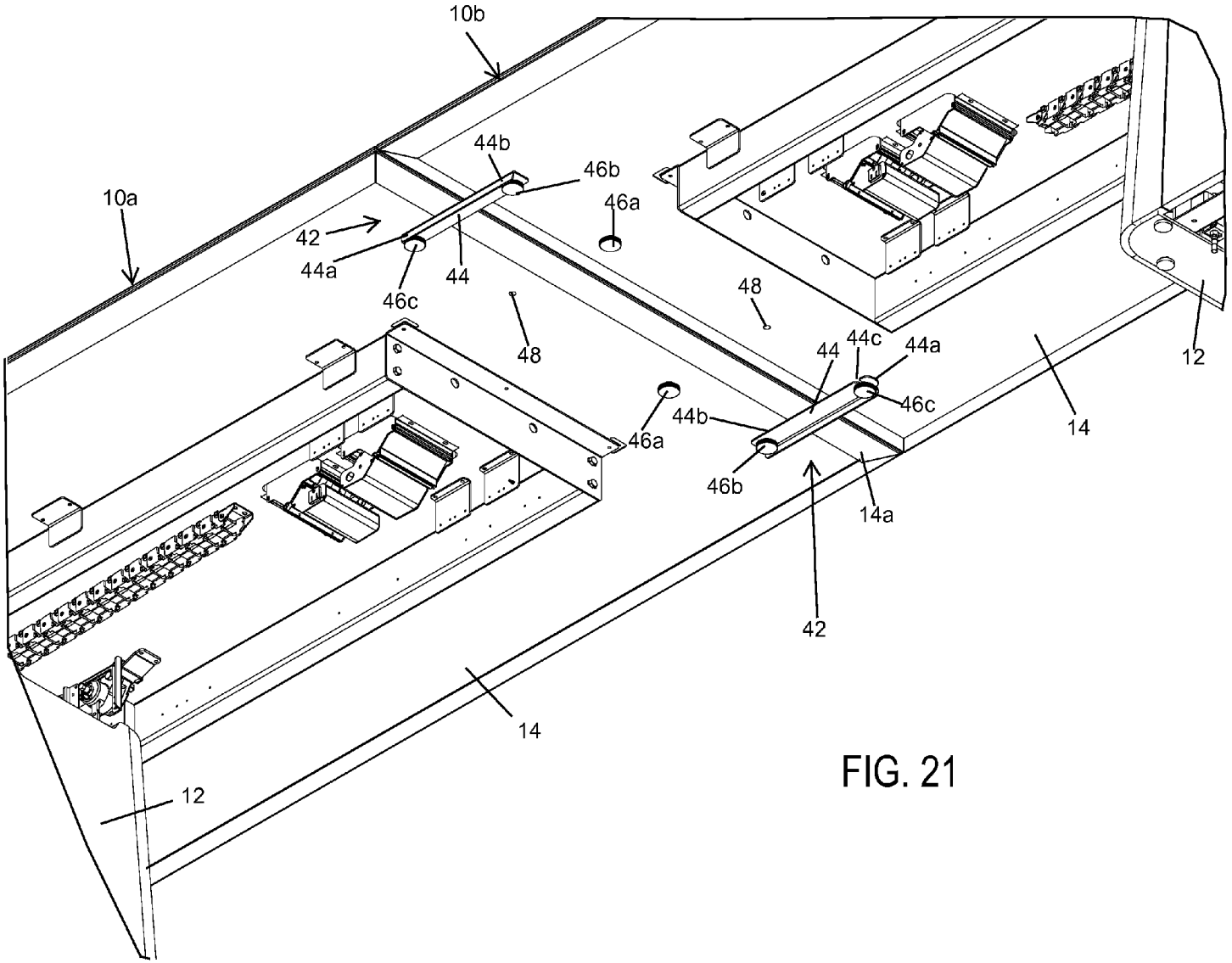
FIG. 21 is an enlarged underside perspective view of a portion of the tables of FIG. 20.

In the illustrated embodiment, the joining means 42 comprises an arm or bracket 44 that is attached at the underside of the table tops via a fastener 46 (such as a threaded fastener or the like) at each end of the bracket 44 that is threadedly received in a respective threaded bore 48 established at the underside of the table tops. As shown in FIG. 21, two such arms or brackets 44 are provided at or near opposite sides of the table tops to hold the table tops tightly together when in their extended and abutted arrangement. The brackets 44 may comprise any suitable arm or bracket, such as an elongated metallic bracket having an angled portion or L-shaped form or profile to provide enhanced strength and rigidity to the brackets.

Figure 17:
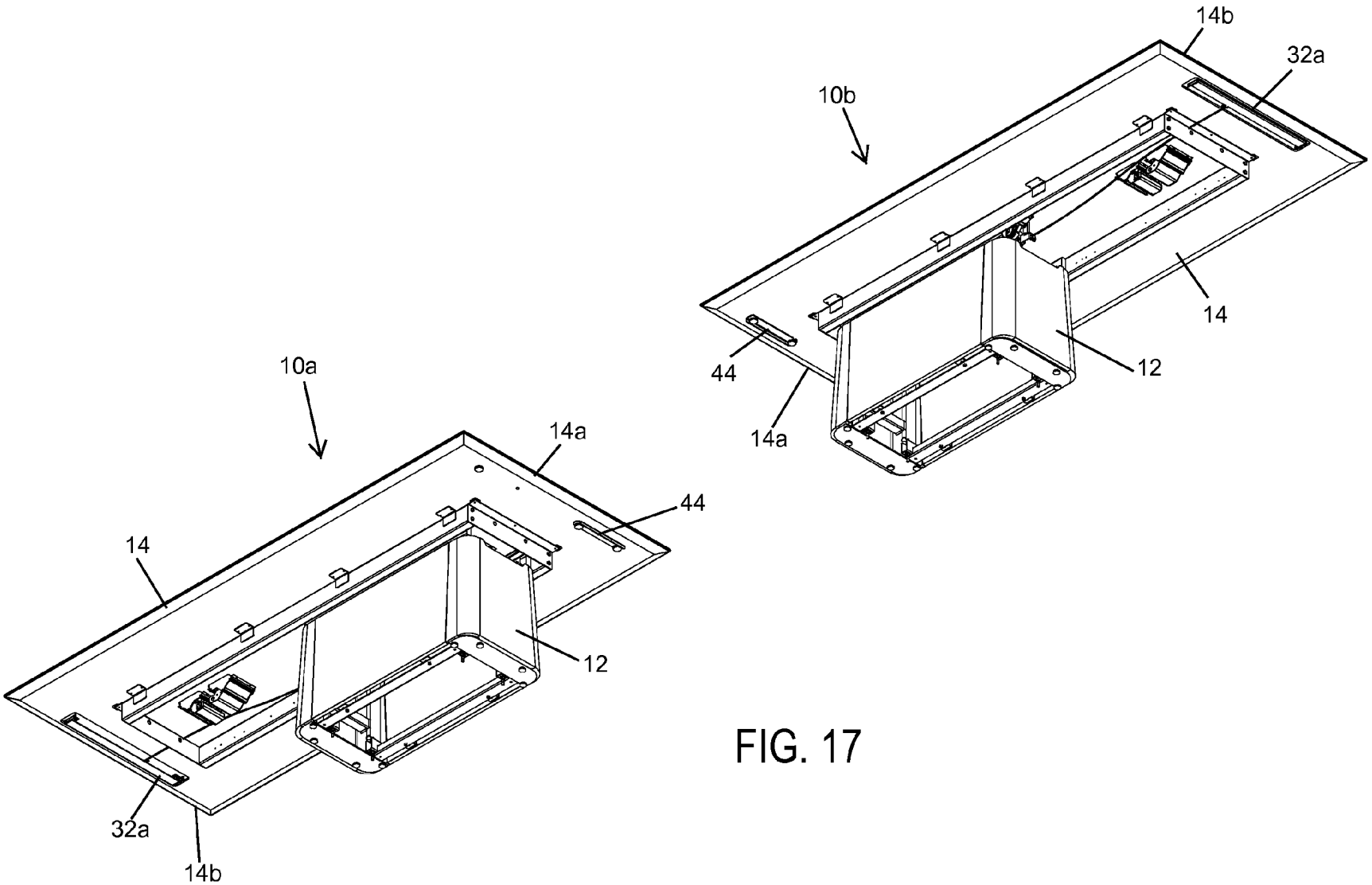
FIG. 17 is an underside perspective view of the tables of FIGS. 15 and 16.
Figure 18:
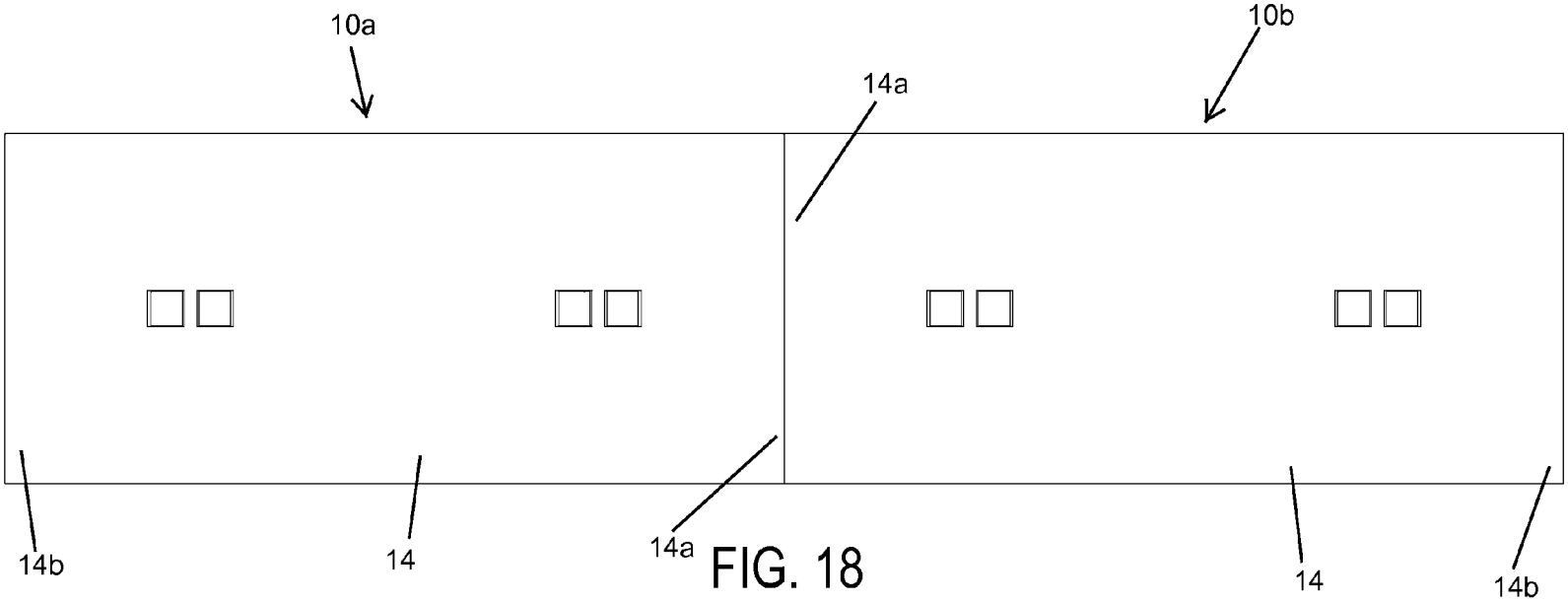
FIG. 18 is a plan view of the tables of FIG. 16, shown with the table tops moved towards and into engagement with one another to provide a single larger table top in accordance with the present invention.
Figure 19:
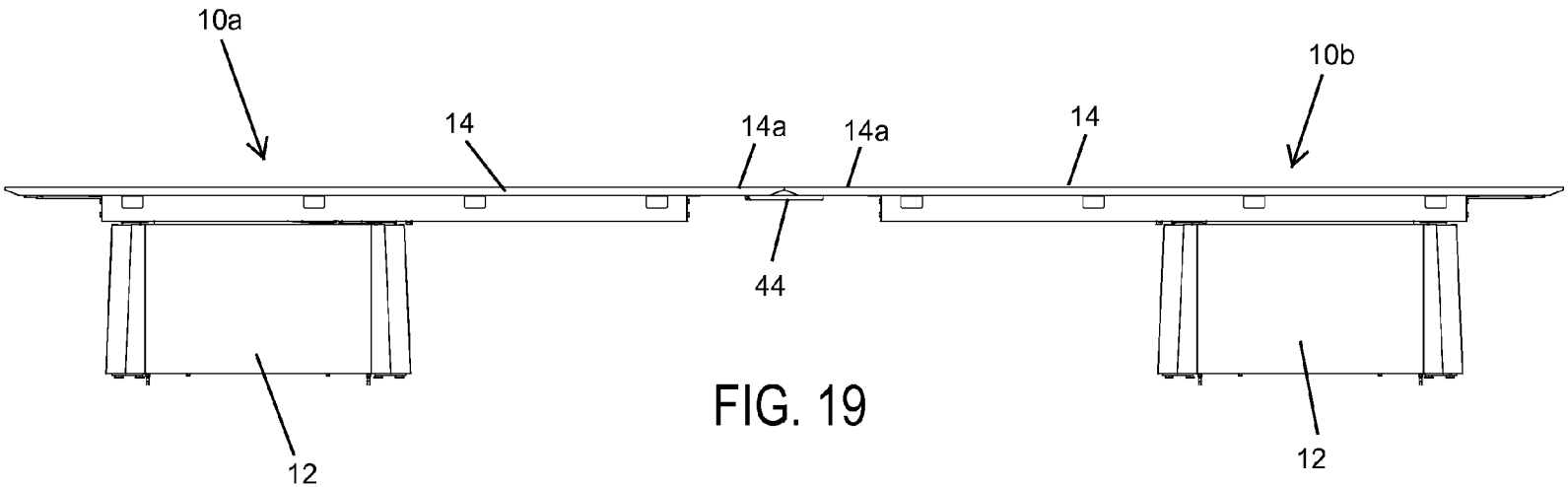
FIG. 19 is a side elevation of the tables of FIG. 18.
Figure 20:
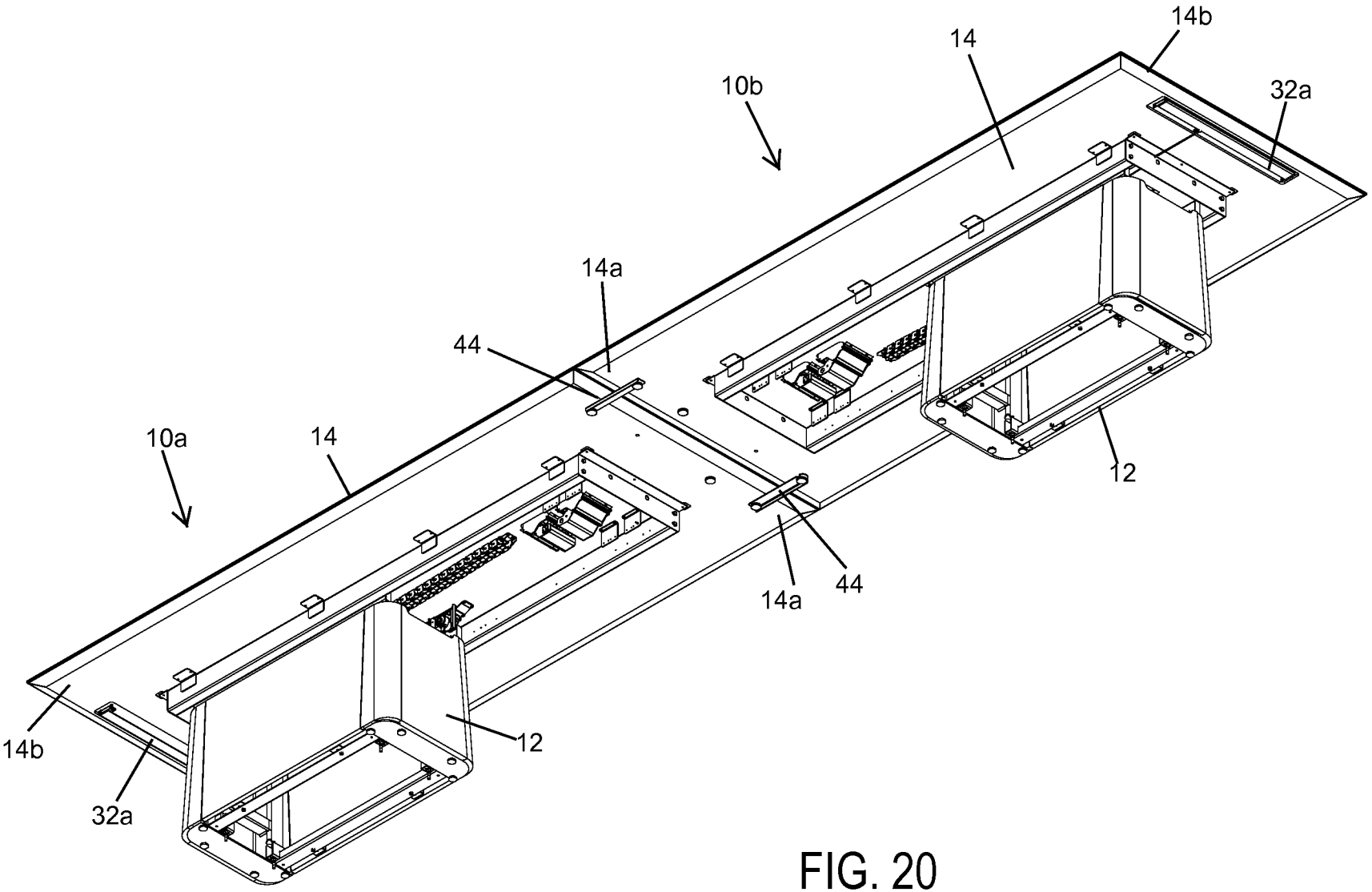
FIG. 20 is an underside perspective view of the tables of FIGS. 18 and 19.

When the table tops are separated (such as shown in FIGS. 15-17), the brackets or arms 44 may be attached at a side region of the respective table tops via two fasteners 46*a*, 46*b* (such that the table top 14 of one table 10*a* has one bracket attached at its end 14*a* and the table top 14 of the other table 10*b* has another bracket attached at its end 14*a*). When it is desired to abut the tables and deploy the retaining or joining means 42, one of the fasteners 46*a* may be loosened or removed (such as from an inboard end 44*a* of the brackets) and the brackets 44 may be pivoted about the other fastener 46*b* so as to extend from the respective table top and to extend below the end 14*a* of the other table top. When the table tops are extended or positioned in this manner, a fastener 46*c* may be used to secure the end 44*a* of the brackets at the other table top to retain the table tops in their abutted arrangement. Optionally, the table tops may have a wood grain pattern established thereon (or other desired pattern), and the patterns may be configured or established such that any lines or patterns at the abutting end of one table top generally align with and correspond to the lines or patterns at the abutting end of the other table top, so as to enhance the uniform appearance of the table tops when joined together (such as by utilizing aspects of the tables described in U.S. Pat. No. 8,096,244, which is hereby incorporated herein by reference in its entirety.

Optionally, each table may include one bracket 44 and three fasteners 46*a*, 46*b*, 46*c*, such that, when the tables are not joined, the bracket 44 is attached at the table top via fasteners 46*a* and 46*b*, with a third fastener 46*c* retained in a threaded bore at or near a side of the table top opposite from where fastener 46*b* is disposed. As can be seen in FIG. 21, the end 44*a* of bracket 44 comprises a notched end having a notch 44*c* for receiving the shaft of fastener 46*a* therein when the bracket is not in use. When the table tops are abutted, each fastener 46*a* may be loosened to allow the bracket 44 to pivot away from its stored position (via the shaft of fastener 46*a* passing through the notch 44*c*), and each fastener 46*c* is loosened to allow for positioning of the bracket from the other table at the fastener 46*c* (via the shaft of the fastener 46*c* passing through the notch 44*c*), whereby fastener 46*c* is tightened to secure the bracket to the table top (and fastener 46*b* may also be tightened to secure the bracket 44 relative to the table tops). The joining means 42 thus may be readily used to secure or retain or join the table tops together when in their extended and abutted configurations. Clearly, other joining means may be utilized to retain the table tops in an abutting arrangement. For example, the tables may utilize aspects of the tables described in U.S. Pat. No. 8,096,244, which is hereby incorporated herein by reference in its entirety, to draw the opposing ends of the table tops together to further secure the table tops together when in their extended and abutting state.

Typically, it is desirable to use filler tables between two spaced apart conventional tables to span the gap between the existing tables in order to provide a larger continuous tables. However, such filler tables must be stored somewhere when not in use, causing a potential storage dilemma. In addition, the filler tables do not typically have power and data connections available to those seated at these tables. Further, extra chairs to place along the edges of the filler tables are also required. In these examples, the time to bring in the extra furniture, place it in the room and connect it can easily total twenty minutes or more per change-out and is usually performed by facilities personnel. If this is done several times a day, over an hour of down time per conference room can occur as well as numerous man-hours of the facility's time.

The table system of the present invention provides two adjustable tables that are spaced apart (and optionally in separate or divided or partitioned rooms). With such a table system, turning two smaller tables into one larger table can be done in less than a minute and is performed by the users of the room, not facilities personnel. In addition, because power and data connections move with each table top, every user at the combined or joined table has access to these connections. Further, there is no need to store additional tables and chairs. While filler tables may provide additional seating capacity, customers are often not in need of such additional seating but are forced into this situation because of the static nature of the original two tables, which are tethered to their location because of power and data cabling, and are nearly impossible to move due to their weight.

When used in such an application, the tables of the present invention may be specified as pairs to ensure a consistent grain and color match when brought together. Each table may reside in a respective adjacent room, and may be centered in that room, with the adjacent rooms separated by a removable divider or partition. Once the removable partition is opened, thereby creating one larger room, the table tops of the two tables can be brought together to form one larger table top, including the power and data connections of each table and with a grain-matched or pattern-matched table top.

The table of the present invention thus can easily and quickly adapt to a wide range of activities typically performed by project teams and other highly productive, hard-working teams. The table comprises a moving or sliding top, allowing it to quickly and easily adapt to a broad range of user activities by properly positioning the table top relative to a presentation surface, monitor or paired table in an adjacent room, all without having to move the base of the table or the table itself.

As shown in the drawings, the table of the present invention may have various shaped table tops. For example, for a single table (that is not part of a joining table system) that is for a single room application, such as typical conference rooms and project rooms, the table top may be available in a rectangle shape and/or a radius boat shape (or any other desirable or suitable shape or profile). Optionally, for a dual table system, which may be intended for adjacent room applications where a removable partition is used to separate the rooms (when a partition may be opened to create a single larger conference room and the two table tops are moved together to form one larger table, and with a ganging device to securely connect the table tops together), the tables may be manufactured as a pair of tables with corresponding table tops having correspondingly shaped ends (such as squared or rectangular shaped ends) and optionally having corresponding finishes or the like to ensure grain-matching and/or color-matching between the table tops when they are joined together. When used in such an application, the two tables can each have a different length, but are both generally the same width, and the table tops may be provided in a rectangular shape (or other shape), preferably with a straight abutting edge to provide for a tight abutment or interface when joined together.

The sliding mechanism of the table of the present invention may utilize heavy duty metal ball-bearing slides for a smooth, effortless motion (when the braking device is released or disengaged). The integrated brake mechanism holds the table top in the desired or selected position until a move is desired or necessary. Then, with a simple pull on a release lever at the underside of the table top, the table top can be moved or slid to the desired position by one person with minimal effort and in a matter of seconds. Built-in adjustable stops allow the end positions to be determined during installation. The stops may be adjustable to limit the degree of extension of the table top in either direction depending on the physical constraints of the room in which the table is installed.

The amount of travel for the table top is a function of its overall length. The travel range for single tables allows the table top to be positioned close to an activity wall or to be moved towards the center of a room, allowing enough space for a chair at the end of the table. With dual tables (such as for the table system described above), the travel range allows enough room for a chair at the end of each table when the tables are in the separated rooms while also allowing the adjacent tops to touch or abut one another when brought together to form a joined table. For example, for a table having a table top that is about eight feet long, the degree of movement of the table top may be approximately 30 inches or approximately 33 inches or thereabouts, while for a table that is about thirteen feet long, the degree of movement of the table top may be approximately 60 inches or thereabouts. Clearly, other length tables may be provided, with different degrees of movement of the table tops relative to the bases, while remaining within the spirit and scope of the present invention.

While repositioning furniture is often troublesome, it becomes even more so when power and data connections are involved. However the power and data options in the table top of the table of the present invention move with the sliding table top, so there are no issues with disconnecting and reconnecting power and data, or with cables getting tangled during movement of the table top. The table of the present invention features a built-in cable management track beneath the table top that manages all cables as the table top moves or slides, eliminating any concerns related to this often challenging issue for reconfigurable furniture. Optionally, the table may provide various power and data options, such as for example, a PowerPUP, a Power Cove and/or a Power Center, providing a fully scalable range of power and data connectivity options.

Changes and modifications to the specifically described embodiments may be carried out without departing from the principles of the present invention, which is intended to be limited only by the scope of the appended claims as interpreted according to the principles of patent law including the doctrine of equivalents.

The invention claimed is:

1. A conference room table comprising:

a base;

a table top movably disposed at said base and movable relative to said base between a generally centered position, where said table top is generally centered at said base, and an extended position, where said table top is extended from said base;

a braking device that is operable to retain said table top relative to said base in selected positions between said generally centered position and said extended position and to allow for movement of said table top relative to said base between said generally centered position and said extended position; and wherein said braking device comprises a braking element that engages a braking rail to limit movement of said table top relative to said base.

2. The conference room table of claim 1, wherein said table top is movably disposed at said base via a bearing mechanism having a first rail mounted along one of said base and said table top and a second rail mounted along the other of said base and said table top.

3. The conference room table of claim 1, wherein said table top supports at least one electrical accessory, and wherein wiring extends from said base to said table top via a unidirectional flexing track that flexes in one direction and is substantially non-flexible in a direction transverse to said one direction.

4. The conference room table of claim 1, wherein said braking element is biased towards engaging said braking rail and wherein an operator disengages said braking element from said braking rail to move said table top relative to said base.

5. The conference room table of claim 4, wherein the operator disengages said braking element from said braking rail via actuation of a releasing input at an end region of said table top.

6. The conference room table of claim 1, wherein said table top is movable relative to said base between said extended position, where said table top is extended from said base in one direction, and a second extended position, where said table top is extended from said base in another direction opposite said one direction.

7. The conference room table of claim 1, wherein said base is fixedly secured at the floor or support surface.

8. A dual table system comprising:

a first conference room table comprising a first base and a first table top movably disposed at said first base and movable relative to said first base between a first generally centered position, where said first table top is generally centered at said first base, and a first extended position, where said first table top is extended from said first base;

a second conference room table comprising a second base and a second table top movably disposed at said second base and movable relative to said second base between a second generally centered position, where said second table top is generally centered at said second base, and a second extended position, where said second table top is extended from said second base;

wherein said first and second bases are spaced apart from one another at a support surface of a room;

wherein, when said first table top is in said first generally centered position and said second table top is in said second generally centered position, opposing ends of said first and second table tops are spaced apart from one another; and wherein, when said first table top is in said first extended position and said second table top is in said second extended position, said opposing ends of said first and second table tops abut one another and cooperate to form a single table top.

9. The dual table system of claim 8, wherein, when said first table top is in said first generally centered position and said second table top is in said second generally centered position, a partition is removably disposed between said first and second table tops such that said first table is disposed in a first room and said second table is disposed in a second room.

10. The dual table system of claim 9, wherein said first table top comprises a first pattern or color and wherein said second table top comprises a second pattern or color, and wherein said first and second patterns or colors generally correspond to one another at least at said opposing ends of said first and second table tops.

11. The dual table system of claim 9, wherein said first table includes a joining element at said opposing end of said first table top, and wherein said joining element is configurable to attach at said opposing end of said second table top when said opposing ends of said first and second table tops abut one another.

12. The dual table system of claim 8, wherein said first table top supports at least one electrical accessory, and wherein wiring extends from said first base to said first table top via a unidirectional flexing track that flexes in one direction and is substantially non-flexible in a direction transverse to said one direction.

13. The dual table system of claim 8, wherein said first table top is movably disposed at said first base via a bearing mechanism having a first rail mounted along one of said first base and said first table top and a second rail mounted along the other of said first base and said first table top.

14. The dual table system of claim 8, wherein said first table includes a first braking device that is operable to retain said first table top relative to said first base in selected positions and to allow for movement of said first table top relative to said first base between said first generally centered position and said first extended position, wherein said second table includes a second braking device that is operable to retain said second table top relative to said second base in selected positions and to allow for movement of said second table top relative to said second base between said second generally centered position and said second extended position.

15. The dual table system of claim 14, wherein said first braking device comprises a frictional braking element that engages a braking rail to limit movement of said first table top relative to said first base, and wherein said frictional braking element is biased towards engaging said braking rail and wherein an operator disengages said frictional braking element from said braking rail to move said first table top relative to said first base.

16. The dual table system of claim 15, wherein the operator disengages said frictional braking element from said braking rail via actuation of a releasing input at an end region of said first table top.

17. The dual table system of claim 8, wherein said first table top is movable relative to said first base between said first extended position, where said first table top is extended from said first base in one direction, and an opposite first extended position, where said first table top is extended from said first base in another direction opposite said one direction.

18. A method of forming a single substantially continuous table top surface spanning between two adjoining rooms, said method comprising:

providing a first table in a first room, said first table comprising a first base and a first table top movably disposed at said first base and movable relative to said first base between a first generally centered position, where said first table top is generally centered at said first base, and a first extended position, where said first table top is extended from said first base;

providing a second table in a second room, said second table comprising a second base and a second table top movably disposed at said second base and movable relative to said second base between a second generally centered position, where said second table top is generally centered at said second base, and a second extended position, where said second table top is extended from said second base;

providing a partition and positioning said partition between said first and second table tops to define a wall of said first room and a wall of said second room when said first and second table tops are not in said first and second extended positions;

removing said partition from between said first and second table tops;

moving said first table top to said first extended position, wherein opposing ends of said first and second table tops abut one another when at least said first table top is in said first extended position, and wherein, when said opposing ends abut one another, said first and second table tops cooperate to form a single table top; and joining said opposing end of said first table top to said opposing end of said second table top.

19. The method of claim 18, including moving said second table top to said second extended position to abut said opposing ends together when said first table top is moved to said first extended position.

20. The method of claim 18, wherein said first table includes a first braking device that is operable to retain said first table top relative to said first base in selected positions and to allow for movement of said first table top relative to said first base between said first generally centered position and said first extended position, and wherein said second table includes a second braking device that is operable to retain said second table top relative to said second base in selected positions and to allow for movement of said second table top relative to said second base between said second generally centered position and said second extended position.

21. The method of claim 18, including fixedly securing said first base in said first room and fixedly securing said second base in said second room.

* * * * *